US005171480A

United States Patent [19]

Yoshinaka et al.

[11] Patent Number: 5,171,480

[45] Date of Patent: Dec. 15, 1992

[54] ELECTROPHOTOGRAPHIC PHOTOSENSITIVE MEMBER CONTAINING A CONDUCTIVE LAYER WHICH COMPRISES A RESIN AND A CONDUCTIVE ZINC OXIDE HAVING A TETRAPAD STRUCTURE

[75] Inventors: Minoru Yoshinaka; Eizo Asakura; Mitsumasa Oku, all of Osaka; Motoi Kitano, Kawanishi; Yoshio Nakatani, Chigasaki; Hideyuki Yoshida, Amagasaki; Toshiya Hatta, Kamakura; Seiichi Nakatani, Osaka, all of Japan

[73] Assignee: Matsushita Electric Industrial Co., Ltd., Japan

[21] Appl. No.: 785,379

[22] Filed: Oct. 30, 1991

Related U.S. Application Data

[62] Division of Ser. No. 399,116, Aug. 28, 1989.

[30] Foreign Application Priority Data

Aug. 29, 1988 [JP] Japan ..... 63-214007
Sep. 8, 1988 [JP] Japan ..... 63-225017

[51] Int. Cl.[5] ..... G03G 5/04; H01B 1/14

[52] U.S. Cl. ..... 252/518; 430/63; 252/500

[58] Field of Search ..... 430/63; 252/500, 518

[56] References Cited

U.S. PATENT DOCUMENTS

| | | | |
|---|---|---|---|
| 2,331,599 | 10/1943 | Cyr | 423/62 |
| 3,639,121 | 2/1972 | York | 430/63 |
| 3,684,503 | 8/1972 | Humphriss et al. | 430/63 |
| 4,657,835 | 4/1987 | Yashiki | 430/63 |
| 4,960,654 | 10/1990 | Yoshinaka et al. | 428/614 |
| 5,066,475 | 11/1991 | Yoshinaka et al. | 428/614 |

FOREIGN PATENT DOCUMENTS

| | | |
|---|---|---|
| 0325797 | 8/1989 | European Pat. Off. . |
| 50-25303 | 3/1975 | Japan . |
| 51-15748 | 5/1976 | Japan . |
| 52-117134 | 1/1977 | Japan . |
| 52-58924 | 5/1977 | Japan . |
| 52-24414 | 7/1977 | Japan . |
| 52-113735 | 9/1977 | Japan . |
| 53-133444 | 11/1978 | Japan . |
| 55-25059 | 2/1980 | Japan . |
| 55-96975 | 7/1980 | Japan . |
| 55-124152 | 9/1980 | Japan . |
| 55-146453 | 11/1980 | Japan . |
| 55-157748 | 12/1980 | Japan . |
| 56-25746 | 3/1981 | Japan . |
| 56-66854 | 6/1981 | Japan . |
| 56-158339 | 7/1981 | Japan . |
| 56-34860 | 8/1981 | Japan . |
| 56-143443 | 9/1981 | Japan . |
| 56-53756 | 12/1981 | Japan . |
| 57-30846 | 2/1982 | Japan . |
| 57-138990 | 8/1982 | Japan . |
| 58-31344 | 2/1983 | Japan . |
| 58-121044 | 7/1983 | Japan . |
| 58-217941 | 12/1983 | Japan . |
| 59-15600 | 1/1984 | Japan . |
| 59-84257 | 5/1984 | Japan . |
| 59-97151 | 6/1984 | Japan . |
| 59-97152 | 6/1984 | Japan . |
| 59-121343 | 7/1984 | Japan . |
| 59-220743 | 12/1984 | Japan . |
| 59-223445 | 12/1984 | Japan . |

*Primary Examiner*—Paul Lieberman
*Assistant Examiner*—Bradley A. Swope
*Attorney, Agent, or Firm*—Lowe, Price, LeBlanc & Becker

[57] ABSTRACT

A conductive composition containing at least zinc oxide whiskers having a tetrapod structure. The conductive composition can be used to provide a conductive resin composition and a conductive coating composition, which have various uses, particularly in conductive layers, conductive supports or protective layers of electrophotographic photosensitive members.

30 Claims, 5 Drawing Sheets

10 μm

10 μm

ELECTROPHOTOGRAPHIC PHOTOSENSITIVE MEMBER CONTAINING A CONDUCTIVE LAYER WHICH COMPRISES A RESIN AND A CONDUCTIVE ZINC OXIDE HAVING A TETRAPAD STRUCTURE

This application is a divisional application of application Ser. No. 07/399,116 filed Aug. 28, 1989.

BACKGROUND OF THE INVENTION

1. Field of the Invention

This invention relates to a conductive composition, and more particularly, to a conductive composition which is an organic composition such as a conductive resin composition and a coating composition. Still more particularly, it relates to a conductive resin composition used in the form of a compound, paste, molded product, putty or the like, particularly in the field concerning semiconductors, covering a vast range including materials used for packaging, storage and transportation for the purpose of preventing electrostatic destruction, floorings used for prevention of electrostatic charging or removing electrostatic charges, shielding materials used for preventing electromagnetic wave hindrance, wire coating compositions used for preventing corona discharge deterioration, and synthetic resin thermisters.

This invention also relates to a highly conductive resin composition, which is used in the form of a paste, putty, coating composition, compound, pellets, molded product, sheet, film or the like and applied in the field covering a wide range, particularly in the field in which both a high conductivity and a high plasticity are required, including circuit wiring, take-out of electrodes, electrical contacts, plastic electrodes, conductive coating compositions, conductive films, surface heater elements, conductive plastics, conductive rubbers, conductive tires, connecter gaskets, electromagnetic shielding materials, antistatic materials, and wire coating compositions for preventing corona discharge.

This invention further relates to a method of making a conductive resin composition useful for forming a conductive resin film, and more particularly to a method of making a conductive resin composition that can be formed into a sheet, film, paste, coating composition or the like and used in antistatic materials or conductive coating compositions used for electrostatic coating.

This invention still further relates to a conductive composition utilized in an electrophotographic photosensitive member, and more particularly to a conductive composition used to obtain an improved conductive layer, conductive support or protective layer.

2. Description of the Prior Art

As materials or fillers compounded into a resin to impart the resin an electrical conductivity, metals such as silver, copper, aluminum, nickel, palladium and iron, metallic compounds such as silicon carbide, tin oxide, indium oxide and zinc oxide, and non-metals such as carbon are used in a crystal or amorphous and flaky, powdery or fibrous form. To obtain high and stable conductive compositions using these fillers, it is important for these fillers to be uniformly dispersed in a resin. For this end, the above powdery or flaky materials have been required to be, for example, pulverized to have finer particles, or made to have a smaller thickness, respectively, and the fibrous materials, to be made to have smaller diameter. However, particularly in the instance of metallic fillers, the fillers are affected by moisture or oxygen in the course of the above treatment or storage to give an oxide film produced on the surface, so that it is often difficult to obtain the desired electrical conductivity even if they are dispersed in a good state. Other compounds may similarly be often adversely affected by hydrolysis. In the instance of chemically stable compounds or fibrous materials, only a small effect can be obtained in taking the means for making them finer, e.g., in carrying out pulverization or the like. This requires a special mans for making them finer and also results in an increase in treatment cost. For these reasons, there is a limit in making particle size smaller or making materials finer in a preferable state, for the purpose of their dispersion in resins, so that materials with relatively course size have had to be used as they are. This consequently causes separation of resin from the filler after they have been compounded, tending to give a heterogeneously dispersed state and also often resulting in difficulty in long-term maintenance of electrical conductivity. In particular, it has often occurred that no desired electrical conductivity can be attained unless the materials are charged in a large amount.

On the other hand, it is also well known to use particulate, flaky or fibrous conductive or non-conductive fillers of various types whose surfaces are coated with conductive materials comprising a metal or a metal oxide such as indium oxide or tin oxide.

In regard to the conventional conductive resin compositions, they have so a large amount of filler component that the resulting resin composition necessarily has a small amount of resin component, resulting in a deterioration of various excellent properties inherent in resins. Such deterioration includes a lowering of mechanical strength, a lowering of flexibility, an increase in the density of a composition, a difficulty in molding, a decrease in glossiness, and an increase in cost because of the use of a large amount of expensive fillers.

In regard to the conductive coating compositions, the addition of a large amount of the metallic conductive materials such as copper, aluminum, iron and nickel brings about a lowering of the mechanical properties of coatings, and also the copper, aluminum, iron, etc. have had the disadvantages such that the electrical conductivity is lowered because of the formation of an oxide layer on the surface and the coatings are deteriorated because of copper or iron oxides. Now, inexpensive and highly stable carbon black has been hitherto used, but ths is accompanied with the disadvantage that hues are limited.

To discuss next the electrophotographic photosensitive member, it is fundamentally comprised of a support and provided thereon a photosensitive layer. The support more takes the form of a cylinder than the form of a sheet. This is because the jointless construction of the cylinder is advantageous for the continuous repeated application of charging, exposure, developing, fixing and destaticizing in the electrophotographic process.

In recent years, development has been remarkably made on electrophotographic printers that employ laser beams. Used as the electrophotographic photosensitive member used in laser beam printers are inorganic photosensitive members comprising selenium, cadmium sulfide or amorphous silicon and organic photosensitive members comprising polyvinyl carbazole, oxadiazole or phthalocyanine.

As laser beam sources, argon or helium-neon gas lasers have been hitherto used, but semiconductor lasers are recently used for the purpose of making apparatus more compact, more lightweight and more inexpensive. Taking account of the copying speed, resolution, and lifetime of the semiconductor laser, a reversal development system is also proposed in which a toner is adhered on the exposed area having a low potential.

However, because of the wavelength of the semiconductive laser, which is in the infrared region of from 700 to 850 nm, the above photosensitive member has so a low light-sensitivity in this wavelength region that this has been undesirable from a practical viewpoint. Now, several sensitizing methods are proposed. Known as the most effective method is to provide a functionally separated photosensitive layer comprising a lamination of a charge generation layer and a charge transport layer. The charge generation layer should preferably be a thin film because a greater part of the amount of exposure is absorbed in the charge generation layer to produce a large number carriers and also because the carriers thus produced must be injected into the charge transport layer without the recombination and trapping. Thus, from the viewpoints of the copying speed, resolution and lifetime of the semiconductive laser, the reversal development system in which a toner is adhered on the exposed area having a low potential is now prevailingly used.

In instances in which the semiconductor laser is used as a light source, however, no problem arises in line images such as letters or the like, but interference bands appear in halftone solid images. This is caused by the charge generation layer which is formed of a thin film as mentioned above, where the light that should have been absorbed in this layer is not absorbed in its entirety and reflects in part on the surface of the support, resulting in interference between this reflected light and the light reflected on the surface of the photosensitive layer.

Incidentally, in instances in which the material for the support comprises an insulating material such as paper or plastics, a conductive film must be formed on the support so that the charges can be immediately let off. In instances in which the support comprises a metal such as aluminum, copper, zinc, tin, stainless steel, brass or chromium, the conductive film may not be formed but, when an ordinary development system is taken, electrical failure of the photosensitive layer, or irregularities, scratches or defects on the conductive support come out as white dots in solid black on an image. When the reversal development system is taken, they come out as black dots in solid white on an image. These are great problems in both cases.

Now, to solve these problems, it is effective to provide a resin layer between the support and photosensitive layer. This resin layer must be a layer with an electrically sufficiently low resistivity, and should preferably be a resin layer having an electrical conductivity, which is usually called a conductive layer. The conductive layer is required to be not attacked by a solvent used in a coating solution for a coating formed thereon, and methods are known in which a cationic, anionic or nonionic electrolyte, or a polymeric electrolyte such as a quaternary ammonium salt or sulfonate is added in a hydrophilic resin or alcohophilic resin such as polyvinyl alcohol, ethyl cellulose, casein, gelatin or starch (for example, Japanese Patent Publications No. 56-54631 and No. 58-1772, Japanese Laid-open Applications No. 57-138990 and No. 59-121343). This layer, though depending on the degree of the irregularities, scratches or defects of the support, is not effective when it is a thin film, and thus required to be a film with a thickness of not less than 5 μm.

It is also important for the electrophotographic photosensitive member to have moisture resistance, durability, and cleaning resistance. It is also important for its electrical resistance not to be affected by changes in use environments, in particular, changes in humidity. Under conditions of a low humidity of 10° C./20% in winter seasons, it may follow that the electrical resistance increases to cause fog in the case of the ordinary developing system and cause a lowering of image density in the case of the reversal development system. On the other hand, under conditions of a high humidity of 30° C./80% in rainy seasons, the electrical resistance may decrease to tend to cause the injection of charges from the support, resulting in the appearance of white dots in solid black on an image in the case of the ordinary development system, and black dots in solid white on an image in the case of the reversal development system.

To cope with the changes in use environment, a method is proposed in which the photosensitive member is heated with a heater built in the photosensitive member to effect dehumidification (for example, Japanese Laid-open Applications No. 55-96975 and No. 58-31344). This method, however, brings about an increase of an electric power and an increase in the apparatus cost, and is not preferred.

Incidentally, in the course of electrophotographic process, the photosensitive member is usually repeatedly used, so that charge deterioration, exposure deterioration, ozone deterioration, scratches due to toner, etc. may occur in the vicinity of the surface of the photosensitive member, resulting in an impairment of the lifetime of the photosensitive member. Now, a method is available in which a protective layer is further provided on the photosensitive layer. This protective layer is proposed to comprise polyester resin, urethane resin, polyvinyl butyral resin, phenol resin, cellulose acetate, a styrene/maleic anhydride copolymer, a polyamide, or the like (for example, Japanese Patent Publications No. 51-15748, No. 52-24414, No. 56-34860 and No. 56-53756). This method, however, can not be said to be satisfactory from the viewpoints of adhesion to photosensitive layers, scratches, durability such as slide resistance, environment resistance stability, etc.

As properties required in the conductive layer of the electrophotographic photosensitive member, it is also important for it not to be affected by changes in use environment, in particular, changes in humidity, as having been discussed in the above. When the conductive layer based on ion conduction is used, under conditions of a low humidity of 10° C./20% in winter seasons, it may follow that the electrical resistance increases to cause fog in the case of the ordinary developing system and cause a lowering of image density in the case of the reversal development system. On the other hand, under conditions of a high humidity of 30° C./80% in rainy seasons, the electrical resistance may decrease to tend to cause the injection of charges from the support, resulting in the appearance of white dots in solid black on an image in the case of the ordinary development system, and black dots in solid white on an image in the case of the reversal development system.

To cope with this, proposed are a method in which a metal deposit film or metallic coating is applied or a metallic foil is wrapped around as a conductive layer that has no humidity dependence and may not bring about neither an increase in the electrical resistance nor the interference bands even if the film thickness is made larger (for example, Japanese Laid-open Application No. 55-124152), a method in which a metallic powder of nickel, copper, silver, aluminum or the like is dispersed in a binder resin (for example, Japanese Laid-open Application No. 56-158339), a method in which carbon black is dispersed in a binder resin (for example, Japanese Laid-open Applications No. 50-25303 and No. 52-113735), and a method in which ZnO doped with Al or In, $TiO_2$ doped with Ta, $SnO_2$ doped with Sb or Nb, or ZnO, TiO, $TiO_2$, $SnO_2$, $Al_2O_3$, $In_2O_3$, $SiO_2$, MgO, or a composite metal oxide of any of these is dispersed in a binder resin (for example, Japanese Laid-open Applications No. 55-146453, No. 56-143443, No. 58-217941 and No. 59-84257).

Also proposed is a method in which a conductive support comprising an insulating material such as paper or plastics filled with carbon or fiber of a metal such as aluminum, copper, brass, stainless steel or zinc (for example, Japanese Laid-open Applications No. 56-66854, No. 59-15600 and No. 59-97151).

In the instance in which the metal deposit film is applied, the method has the disadvantages that a batch system must be employed and moreover gas generates from the support, or it takes a long time to attain a film thickness without pin holes.

In the instance in which the metallic coating is applied, the method has the disadvantages that a primer treatment is required and it is difficult to maintain and control a plating bath.

In the instance in which the metallic foil is wrapped around, the method has the disadvantage that it is difficult to wrap around it with a good precision, using an endless metallic foil so that no joint area may be formed.

In the instance in which ZnO doped with Al or In, $TiO_2$ doped with Ta, $SnO_2$ doped with Sb or Nb, or ZnO, TiO, $TiO_2$, $SnO_2$, $Al_2O_3$, $In_2O_3$, $SiO_2$, MgO, or a composite metal oxide of any of these is dispersed in a binder resin, a conductive layer having superiority as to environment dependence can be obtained. The method, however, has the disadvantages that since the above metallic powders or metallic oxides are insoluble to the binder resin and solvent in a coating solution and are in a bulky form and also the electrical conductivity is based on electron conduction, an area locally having a different resistance may be formed and no stable conductive layer may be obtained unless they are added in a large amount, and that because of their specific gravity which is as large as 3 to 8 they tend to be sedimented when they are dispersed in the coating solution, so that the operability becomes poor and no stable conductive layer can be obtained.

In the instance in which the material is filled with carbon, there are the disadvantages that the photosensitive member has the nature of injecting free carriers into the photosensitive layer, an area locally having a different resistance may be formed and no stable conductive layer may be obtained unless it is added in a large amount, and the thixotropy is so high that operability can be achieved with difficulty.

In the instance in which the material is filled with metallic fiber, there can be obtained a superior mechanical strength, slidability and electrical conductivity in the longitudinal direction. However, the method has the disadvantages that no stable mechanical strength, slidability and electrical conductivity can be obtained in the film thickness direction unless it is added in a large amount, and the adhesion can be little improved even if it is added in a large amount.

Incidentally, whiskers are meant to be beard-like single crystals, and refer to single crystals having a length not less than several times the average diameter. Linear-fibrous whiskers of potassium titanate, silicon carbide, silicon nitride, etc. are known in the art, and those to which electrical conductivity has been imparted are commercially available. Of these, a method in which a plastics filled with whiskers of potassium titanate is used in a conductive support is proposed in Japanese Laid-open Application No. 59-97152. Like the metallic fiber, there can be obtained a superior mechanical strength, slidability and electrical conductivity in the longitudinal direction because of the linear-fibrous form of the whiskers, but no stable mechanical strength, slidability and electrical conductivity can be obtained in the film thickness direction unless it is added in a large amount, and the adhesion can be little improved even if it is added in a large amount.

In regard to the electrophotographic photosensitive member employing the protective layer, a method is proposed in which a protective layer comprising fine powder of fluorine resin, silicone resin, polytetrafluoroethylene, polyethylene, polyethylene terephthalate or the like dispersed in a binder resin is used so that the durability such as slide resistance can be improved (for example, Japanese Laid-open Applications No. 52-117134, No. 55-25059, No. 56-25746 and No. 59-220743). The method disclosed in these can achieve a superior durability but has the disadvantages that the electrical resistance is so high that it remains as residual potential to cause fog in the case of the ordinary development system, and bring about a lowering of image density in the case of the reversal development system, and also that methods of preparing photosensitive members may be limited because of the materials insoluble to solvents.

For the purpose of not causing the fog as a result of an increase in residual potential, a method is also proposed in which a Lewis acid such as 2,4-dinitrobenzoic acid, phthalic anhydride, 2,6-dinitro-p-benzoquinone or p-bromanil is added in the protective layer so that a relatively slight trap may be formed without trapping of charges at the interface between the protective layer and photosensitive layer (for example, Japanese Laid-open Applications No. 53-133444 and No. 55-157748). There, however, may arise the problem that the durability such as scratch resistance and slide resistance are lowered.

Hence, an excessively low resistance of the protective layer results in the movement of charges in the lateral direction to cause a lowering of electrostatic charge potential. On the other hand, an excessively high resistance results in the accumulation of charges to increase residual potential, so that it is necessary to control the resistance of the protective layer to a suitable value and also make the resistance stable to the changes in use environment such as temperature and humidity. In addition, the protective layer must have a film thickness which is relatively thin to the extent that it may not substantially affect the resolution of the photosensitive layer, and also must be excellent in the durability such as scratch resistance and slide resistance.

Now, proposed is a method in which a protective layer comprising a metallic oxide dispersed in a binder resin (for example, Japanese Laid-open Applications No. 57-30845, No. 58-121044 and No. 59-223445). This method can obtain a photosensitive member free from charge accumulation accompanying repeated use and stable even to the changes in use environment. Since, however, the metallic oxide contained in the binder resin is insoluble to the binder resin and solvent and is in a bulky form, the optical characteristics may differ depending on the state of dispersion thereof even when it is contained in the protective layer in a constant amount. For example, the presence in the protective layer, of relatively large particles or of agglomerates because of non-uniform state of dispersion results in a lowering of the transparency of the protective layer to cause a lowering of the light-sensitivity of the photosensitive member and a lowering of image quality.

Incidentally, as previously mentioned, whiskers are meant to be beard-like single crystals, and refer to single crystals having a length not less than several times the average diameter. Linear-fibrous whiskers of potassium titanate, silicon carbide, silicon nitride, etc. are known in the art, and those to which electrical conductivity has been imparted are also commercially available. These can achieve a superior mechanical strength, slidability and electrical conductivity in the longitudinal direction, but no stable mechanical strength, slidability and electrical conductivity can be obtained in the diameter direction, i.e., the film thickness direction unless it is added in a large amount. If for that reason they are added in a large amount, the sensitivity of the photosensitive layer may be lowered because of a lowering of the transparency of the protective layer and moreover the adhesion can be little improved even if it is added in a large amount.

SUMMARY OF THE INVENTION

Accordingly, it is an object of the present invention to provide a composition with high dispersion, that employs novel zinc oxide whiskers as a conductive filler and has achieved a very efficient and stable electrical contact in a resin, which is different from the prior art, i.e., the techniques in which the high dispersion and high electrical conductivity are achieved by making smaller or finer the particles of conductive fillers.

It is another object of the present invention to provide a composition with a high electrical conductivity and high plasticity, that can impart a high electrical conductivity by only incorporating in a resin composition a small amount of filler, retaining excellent properties inherent in the resin.

It is still another object of the present invention to provide a method of making a conductive resin film that can obtain a suitable electrical conductivity, may require no limitation on hues, can be free from the deterioration due to oxidation, and has a rich flexibility.

It is a further object of the present invention to provide an electrophotographic photosensitive member having superior environmental properties, in particular, humidity resistance, and having a stable electrical conductivity and superior operability, taking account of the problems previously discussed.

It is a still further object of the present invention to provide an electrophotographic photosensitive member having a protective layer having the durability such as adhesion to the photosensitive layer, scratch resistance and slide resistance and stable to the changes in use environment, taking account of the problems as previously discussed.

The present invention was made on account of the above respective subjects.

In an embodiment, the present invention is a conductive composition containing at least zinc oxide whiskers.

In a preferred embodiment, the present invention is a conductive composition containing zinc oxide whiskers having an aspect ratio of not less than 3.

In a more preferred embodiment, the present invention is a conductive composition containing zinc oxide whiskers each having the shape of a tetrapod structure.

In a still more preferred embodiment, the present invention is a conductive composition employing zinc oxide whiskers comprising any of the above zinc oxide whiskers at least part of which is coated with a conductive material.

The present invention also provides a method of making a conductive composition, comprising;

a first step of subjecting zinc oxide whiskers to a surface treatment using a coupling agent; and a second step of compounding said whiskers into a binder solution;

said zinc oxide whiskers having a tetrapod structure comprised of a central part and a needle crystal part extending to four different axial directions from said central part.

In another embodiment, the present invention is a conductive composition that constitutes a conductive layer positioned between a support and a photosensitive layer of an electrophotographic photosensitive member and containing at least zinc oxide whiskers.

In still another embodiment, the present invention is a conductive composition that constitutes a conductive support of an electrophotographic photosensitive member, made of a resin and filled with at least zinc oxide whiskers.

In a further embodiment, the present invention is a conductive composition that constitutes a protective layer provided on a photosensitive layer of an electrophotographic photosensitive member and containing at least zinc oxide whiskers.

DETAILED DESCRIPTION OF THE PREFERRED EMBODIMENTS

Figure 1:
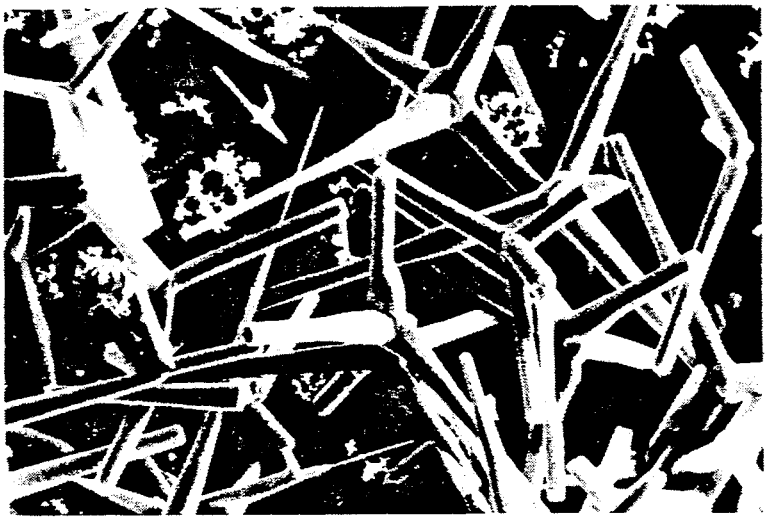
FIGS. 1 and 3 are electron microscope photographs showing magnified crystal structures of the zinc oxide whiskers of the present invention.

The zinc oxide whiskers used in the present invention have a tetrapod-like, three-dimensional specific structure as summarily described above. Thus, when it is compounded into a resin, the needle crystal part of the whiskers is brought into very effective contact with another needle crystal part of the whiskers, so that it is possible to form a stable conducting path with its compounding in a small amount. This achieves a very high contact probability even when compared with simple linear fibrous bodies or flaky fillers that have been hitherto considered advantageous for obtaining electrical contact. The present zinc oxide whiskers, even when used as a mixture in combination with a particulate, flaky or fibrous conductive filler having been hitherto used, can also achieve very higher electrical contact than a system comprised of the above conventional filler alone, and greatly contributes the achievement of a higher electrical conductivity. Also in respect of the dispersibility to a resin, the present whiskers are superior from the fact that the above structure also contributes the dispersibility, in addition to the desirableness in "wettability" attributable to the properties inherent in zinc oxide. The stability originating from the single crystal form further contributes the decrease in deterioration of compositions with time and the improvement in humidity resistance.

The conductive composition that employs surface-coated zinc oxide whiskers will be described below.

From a different viewpoint, however, the tetrapod-like zinc oxide whiskers themselves have an electrical semi-conductivity with a strong light-sensitivity, and therefore, when compounded into the resin, it is difficult to make the composition highly conductive, because of a small electrical conductivity of the whiskers and a large contact resistance thereof when dispersed in the resin. In addition, the tetrapod-like zinc oxide whiskers themselves have an electrical conductivity with light-sensitivity, and therefore, when compounded into the resin, the electrical conductivity in the bulk, electrical conductivity at the dark or electrical conductivity of a dark-tone resin are inevitably greatly lowered (lowered to the order of 2 to 3 or more figures). Thus, no stable electrical conductivity can be imparted. However, in the present invention, the surfaces of the tetrapod-like zinc oxide whiskers are coated with a conductive material, thus giving a stable, highly conductive filler having a very low resistance and free from influence by light.

As mentioned above, the present invention can attain a stable and high electrical conductivity with the compounding of the zinc oxide whiskers in a very small amount, so that there can be realized a conductive resin composition having both a high plasticity and a high electrical conductivity together.

The present zinc oxide whiskers coated with a conductive material, even when used as a mixture in combination with a particulate, flaky or fibrous conductive filler having been hitherto used, can achieve very higher electrical contact than a system comprised of the above conventional filler alone, and greatly contributes the achievement of a higher electrical conductivity. Also in respect of the dispersibility to a resin, the present whiskers are superior from the fact that the coating with a conductive material can improve "wettability" and the tetrapod structure contributes the dispersibility. The stability originating from the single crystal form further contributes the decrease in deterioration of compositions with time and the improvement in humidity resistance.

A conductive coating composition (and a coating formed) will be described below.

In the present invention, the zinc oxide whiskers are compounded into a binder solution having a low viscosity, and hence the whiskers are dispersed between units of the resin of unit molecules or unit particles, making it possible to prepare a coating or film with very high dispersion.

In particular, since in the present invention the three-dimensional tetrapod-like zinc oxide whiskers (specific volume resistivity: about 10 Ω·cm) are compounded, a conducting path can be readily formed in the resin with a low compounding rate. Thus, it becomes possible to prepare a conductive resin film which is rich in flexibility (i.e., filled with inorganic fillers in a low content).

In this instance, however, the size of zinc oxide whiskers and whether or not a surface treatment has been applied are questioned as great factors from the viewpoint of electrical conductivity. A film applied with no suitable surface treatment may cause whiskers to agglomerate each other to give a crumbly film quality, resulting in a lowering of electrical conductivity. On the other hand, a film applied with a suitable surface treatment brings whiskers into good dispersion to give an excellent film quality with smoothness of the surface, so that a good conductive resin film can be prepared.

In regard to the size of the whiskers, those having an excessively large size tend to cause a break and may be sedimented, making dispersion insufficient and resulting in a lowering of electrical conductivity. Whiskers having an excessively small size may cause a lowering of the efficiency of the conducting path formation.

The conductive composition used for the electrophotographic photosensitive member will be described below.

The operation according to this technical means is as follows: A conductive layer containing at least the tetrapod-like zinc oxide whiskers is provided between the support and photosensitive layer, whereby it is possible to obtain a conductive layer having a good adhesion between the support and conductive layer and between the conductive layer and photosensitive layer. In particular, the conductive layer gives a remarkable effect when a photosensitive layer (charge generation layer) in which a phthalocyanine pigment or azo pigment whose adhesion has been hitherto questioned is dispersed, or a photosensitive layer comprising amorphous silicon is formed on the conductive layer. Moreover, no sedimentation may occur when a coating solution is prepared, giving a good operability. Thus it is possible to obtain a conductive layer having a stable electrical conductivity through the tetrapod-like zinc oxide whiskers.

The conductive support that can be obtained by filling a lightweight and inexpensive plastic with the tetrapod-like zinc oxide whiskers can also well satisfy the strength, dimensional stability, impact resistance, etc. required as the support. In the instance of a support made of a metal, the required surface polishing can be omitted, and hence it is possible to obtain a conductive support having a stable electrical conductivity through the tetrapod-like zinc oxide whiskers and having a superior adhesion to the photosensitive layer.

An intermediate layer may be further provided between the conductive layer containing the tetrapod-like zinc oxide whiskers, and the photosensitive layer, whereby it can be made not to occur that a photosensitive material is burried in fine holes caused by the tetrapod-like zinc oxide whiskers, that the photosensitive layer turn uneven because of projections, or that the electrophotographic performance is affected by the mutual action with the photosensitive material. Thus, it is possible to obtain an electrophotographic photosensitive member having a higher reliability and greater lifetime.

In regard to the system in which the protective layer is used, a protective layer containing at least the tetrapod-like zinc oxide whiskers (needle crystals extending to four different axial directions from the central part) is provided on the photosensitive layer. This brings about an excellent adhesion to the photosensitive layer. Moreover, no sedimentation may not occur when a coating solution is prepared, giving a good operability. Thus it is possible to obtain a protective layer having a uniform resistivity without no local difference in the resistivity, through the tetrapod-like zinc oxide whiskers added in a small amount. Besides, since the resistivity is based on electron conduction, a superior environmental stability can be achieved. Thus, it is also possible to obtain an electrophotographic photosensitive member having a protective layer that may not cause any lowering of the resolution of the photosensitive layer and can be stable even to the changes in use environment.

In the present invention, quite novel zinc oxide whiskers are used as the filler or conductive filler.

The present zinc oxide whiskers each have a tetrapod structure, and an electron microscope photograph thereof is shown in FIG. 1.

The above tetrapod-like zinc oxide whiskers can be obtained by subjecting a metallic zinc oxide powder having an oxide film on the surface of each particle, to heating in an atmosphere containing oxygen. The resulting whiskers have an apparent bulk specific gravity of approximately from 0.02 to 0.1, and are obtained in a yield of not less than 70%. The size of the whiskers can also be controlled to a certain extent, according to conditions for the formation of the above oxide film.

FIG. 1 is an electron microscope photograph of the zinc oxide whiskers used in Example 1 set out later. This whiskers can be obtained, for example, in the following manner. Namely, a zinc wire with a purity of 99.99% is flame-sprayed in the air according to flame spraying of an arch discharge system, and 1 kg of the resulting powder is collected. To this powder, 500 g of ion-exchanged water is added, and the mixture is stirred in a crusher of a morter type for about 20 minutes, and thereafter left to stand in water of 26° C. for 72 hours. The resulting product is then dried at 150° C. for 30 minutes, and thereafter put in a crucible made of alumina porcelain. The crucible is put in a furnace kept at 1,000° C., followed by heat treatment for 1 hour. At the upper part of the product, fine whiskers are present in a large quantity. At the middle part to lower part, whiskers as shown in FIG. 1 are obtained, which have an apparent bulk specific gravity of 0.09, a thickness at the needle crystal part, of from 1 to 14 μm and a length thereat of from 10 to 200 μm. In FIG. 1, those having the needle crystal parts of three axes, two axes and also one axis are seen. They, however, are presumed to be those in which part of four-axial crystals has been broken. Those of plate-like crystals are also seen. In any instances, the tetrapod-like zinc oxide whiskers comprise about 80%.

Figure 2:
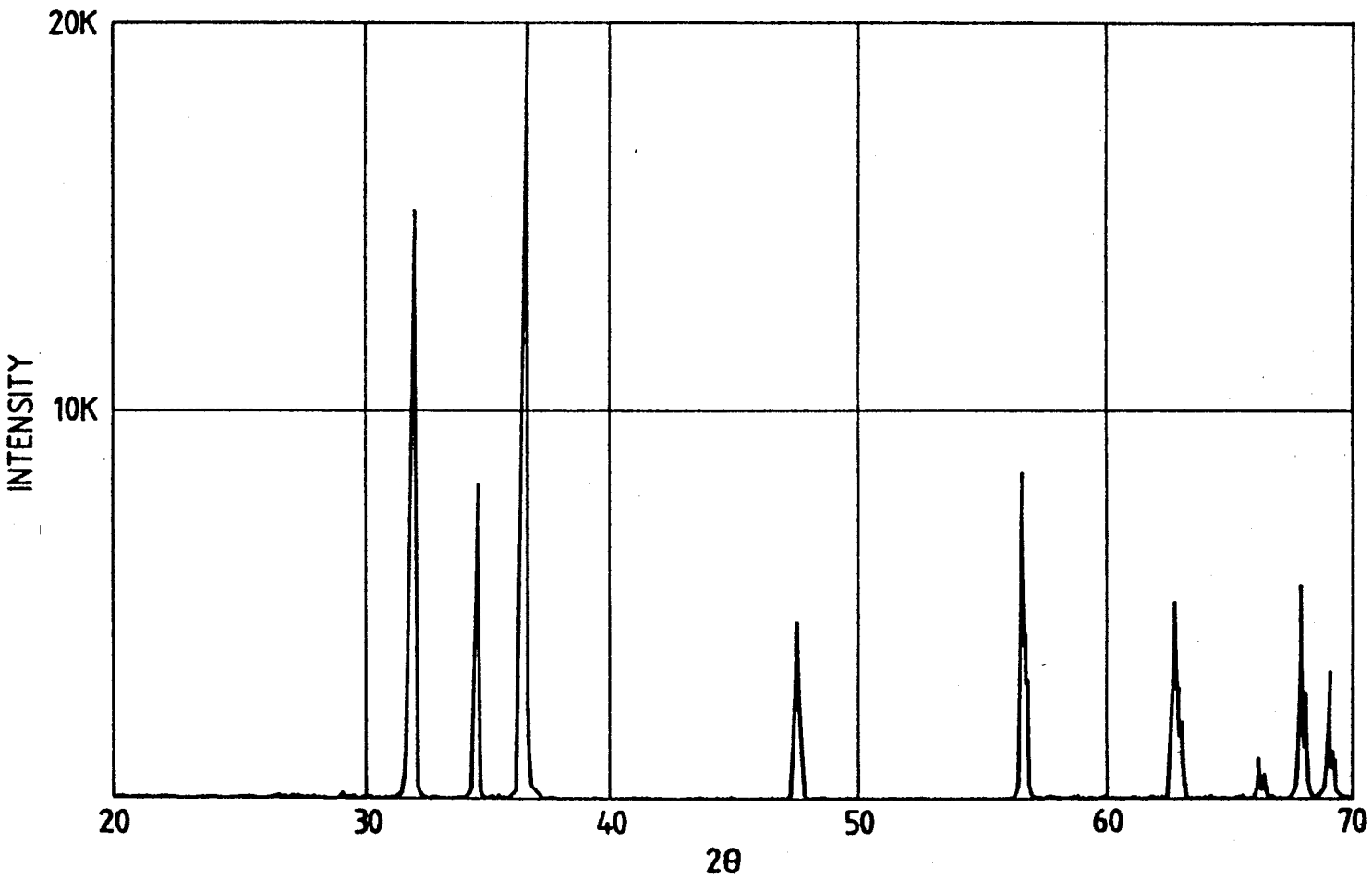
FIG. 2 is an X-ray diffraction pattern of zinc oxide whiskers used in the present invention.

FIG. 2 shows an X-ray diffraction pattern of the above whiskers. Peaks all of zinc oxide are shown, and x-ray diffraction also revealed that the whiskers are single crystals having less transition and lattice defects. An impurity content is also small. As a result of atomic-absorption spectroscopy, a zinc oxide content is found to be 99.98%.

In the conductive resin composition, the novel zinc oxide whiskers are comprised of a central part and a needle crystal part extending to four different axial directions from this central part, and have morphological and dimensional characteristics that the diameter at the base of the above needle crystal part ranges from 0.7 to 14 μm, and particularly from 1 to 14 μm, and the length from the base to top of the needle crystal part ranges from 3 to 200 μm, and particularly from 10 to 200 μm. In other words, a system in which whiskers with larger size (i.e., larger than 200 μm in length and larger than 14 μm in diameter) hold a greater proportion may bring about very poor dispersion, and hence is not preferred as the conductive resin composition. On the other hand, a system in which whiskers with a smaller size (i.e., smaller than 3 μm in length and smaller than 0.7 μm in diameter) hold a greater proportion may bring about poor stability in electrical conductivity, and hence is not preferred except for special instances.

On the other hand, in the conductive coating composition, a system in which whiskers with a larger size (larger than 80 μm in length and larger than 8 μm in diameter) hold a greater proportion (for example, not less than 60 wt. %) or a system in which whiskers with a smaller size (i.e., smaller than 3 μm in length and smaller than 0.7 μm in diameter) hold a greater proportion (for example, not less than 60 wt. %) may bring about a lowering of electrical conductivity, and hence is not preferred except for special instances.

The conductive resin composition will be described below.

Such whiskers may not be separated from the resin in the course of molding, and shows good dispersibility, even when they are compounded into a resin having a low viscosity or a high bulk specific gravity. In the present invention, the zinc oxide whiskers serving as the conductive filler compounded into the resin can sufficiently impart electrical conductivity when compounded alone. However, depending on the purpose for which the composition is made conductive, they can also be used in combination or mixed with other fillers as exemplified by powder, flakes or fiber of silver, copper, aluminum, nickel, palladium, iron, tin oxide, indium oxide, zinc oxide, silicon carbide, zirconium carbide, titanium carbide, highly conductive carbon, graphite, and acetylene black.

As the resin used in the present invention, both the thermoplastic resins and thermosetting resins can be used. The thermoplastic resins include polyvinyl chloride, polyethylene, chlorinated polyethylene, polypropylene, polyethylene terephthalate, polybutylene terephthalate, polyamide, polysulfone, polyetherimide, polyethersulfone, polyphenylene sulfide, polyether ketone, polyether ether ketone, ABS resin, polystyrene, polybutadiene, methyl methacrylate, polyacrylonitrile, polyacetal, polycarbonate, polyphenylene oxide, an ethylene/vinyl acetate copolymer, polyvinyl acetate, an ethylene/tetrafluoroethylene copolymer, polyphenylene oxide, aromatic polyesters, polyvinyl fluoride, polyvinylidene fluoride, polyvinyl chloride, polvinylidene chloride, Teflon, cyanoethylated cellulose, cyanoethylated pluran, polyvinyl alcohol, and nylons.

The thermosetting resins include epoxy resins, unsaturated polyesters, urethane resins, silicone resins, melamine-urea resins, and phenol resins.

There are no particular limitations on the compounding proportion of the conductive filler to the resin. However, an excessively small amount for the compounding can not achieve the purpose for which the composition is made conductive, and an excessively large amount may result in a large specific gravity, bring about a disadvantage in the cost, or cause inhibition of the valuable good dispersibility to produce such an ill effect that the filler projects to the surface. For this reason, there is a preferred range according to the purpose for which the composition is made conductive. That is to say, the conductive filler is compounded in the range of from 5 to 50 vol. %, and preferably from 10 to 30 vol. %, based on the resin.

The conductive resin composition of the present invention comprises the resin and the zinc oxide whiskers, but additives such as stabilizers, dispersing agents and fillers may also be compounded alone or in combination, depending on the purpose for which the composition is used. It is also possible to make this composition into a preferable form such as a powder, pellets or a paste, depending on the purpose for which the composition is used.

The powder can be obtained by mixing the resin and whiskers together with additives optionally compounded, using a mixing machine of a rotary type or fixed type. The pellets can be obtained by similarly carrying out the mixing using the above mixing machine, followed by kneading using a kneader or the like, and then shearing the kneaded product into the desired shape, using a granulator or the like.

The paste can be obtained by adding to the resin and whiskers at least one kind of solvent or low-molecular weight compound optionally together with additives, followed by dispersing and kneading. In regard to the additives optionally compounded as described above, the stabilizers include antioxidants, radical chain terminators as typically exemplified by monobis triphenol and aromatic amines, peroxide decomposers such as mercaptane and monodipolysulfide, metal inactivators such as acid amide and hydrazide, phenols, sulfides, phosphides and ultraviolet absorbents, additives of, for example, a benzophenone type and a benzotriazole type, and also flame-retardants as exemplified by flame-retardants of a bromine type and phosphorus type, as well as flame-retardant auxiliaries such as antimony oxide. The dispersing agents include organic metal salts, and the fillers include carbon black, white carbon, calcium carbonate, clay, silicates, talc, alumina hydrate, asbestos, glass fiber, and carbon fiber, as well as powder or fiber of metals such as gold, silver, nickel, cobalt, iron, aluminum, copper, and stainless steel, to which, however, they are by no means limited. There are no particular limitations on the amount for compounding these compounding agents.

The low-molecular weight compound used in the paste includes carboxylic acids such as diethylene glycol and formic acid, dimers such as diethylene glycol, and trimers such as triethylene glycol. As plasticizers compounded into the thermoplastic resin, there can be used phthalic acid ester, phthalic acid mixed base ester, fatty acid dibasic ester, glycol ester, fatty acid ester, phosphoric acid ester, epoxy plasticizers, and chlorinated paraffin.

The conductive composition that employs the zinc oxide whiskers coated with a conductive material will be described below.

Used as methods for applying the conductive material on the surfaces of the tetrapod-like zinc oxide whiskers are chemical plating processes such as electroless plating and electrolytic plating, various CVD processes, PVD processes such as vacuum deposition, ion plating and sputtering, and coating processes.

The conductive material to be applied includes single materials or alloys, compounds or mixtures of plural kinds of these of elements such as Ag, Cu, Au, Cr, Al, Mo, W, Zn, Ni, Cd, Co, Fe, Pt, Sn, Ta, Nb, Pb, As, Sb, Zr, Ti, La, Bi, Mg, Hg, Ir, Th, V, Tc, Ru, Hf, Re, Os, Tl, In, Ga, U, Si, B, K, Na, Sr, Be, Ca, Ba, Ra, Li, Sc, Y, Ac, O, C and N. Any materials capable of showing intended electrical conductivity under conditions for intended use may be selected. Particularly preferred are materials suffering less deterioration of electrical conductivity, which is due to photo-reaction oxidation, reduction, chemical reaction, and changes with time. From this viewpoint, particularly effective are metals such as Ag, Au, Cu, Cr, Ni and Al, and metallic oxide conductive materials such as indium oxide and antimony tin oxide.

The zinc oxide whiskers themselves are by nature a material having electrical semiconductivity and capable of conducting electricity to a certain degree. Hence, the whole surface of a particle of the whiskers may not necessarily be coated, and may be coated in part depending on the purpose. Sufficient effect can be thus exhibited. The conductive material may be applied with a coating thickness of not less than 25 Å, with which the effect of weakening the electrical conductivity/light dependence of zinc oxide begins to exhibit. A thickness of not less than 100 Å may bring about a sufficient effect from the viewpoint of actual effect, and the conductive properties of composite systems can be made stable.

The present resin composition can be made into a preferable form as exemplified by a powder, pellets, a paste, a coating composition and a casting resin composition, depending on the purpose, and can be used in molding, casting, coating compositions, sheets and films.

In the present invention, the zinc oxide whiskers alone, coated with the conductive material, may be compounded into the resin. A sufficient electrical conductivity can be thereby imparted. Depending on the purpose for which the composition is made conductive, however, it is also possible to use other fillers as exemplified by powder, flakes, beads or fiber of silver, copper, gold, aluminum, nickel, palladium, iron, stainless steel, tin oxide, indium oxide, zinc oxide, silicon carbide, zirconium carbide, titanium carbide, highly conductive carbon, graphite, and acetylene black, or a various kinds of powder, flakes, beads or fiber coated with any of the above materials, and also green tetrapodlike zinc oxide whiskers coated with no conductive material, which may be used alone or as a mixture.

Incidentally, the zinc oxide whiskers having the needle crystal parts of three axes, two axes and also one axis may sometimes be included. They, however, are presumed to be those in which part of four-axial crystals has been broken, as previously mentioned. Those of plate-like crystals may sometimes be seen.

In the conductive resin composition employing the surface-coated zinc oxide whiskers, the zinc oxide whiskers may be compounded in a proportion of from 1 to 50 vol. %, and preferably from 3 to 30 vol. %, based on the resin, though variable depending on the size of the whiskers, the types of the resin and the purpose for which the composition is used, The conductive coating composition (and a resin film or coating formed) will be described below.

A resin film having a high electrical conductivity can be obtained using the zinc oxide whiskers having been subjected to surface treatment with a coupling agent.

The treatment with a coupling agent can be effective when the coupling agent is used in an amount of from 0.005 to 10 wt. % based on the zinc oxide whiskers, and greatly effective particularly in an amount of from 0.01 to 5 wt. %.

The coupling agent that can be used includes silane, chromium or titanium coupling agents, as well as silyl peroxide or organic phosphoric acid coupling agents. Particularly effective are silane coupling agents.

The silane coupling agents used include γ-glycidoxypropyltrimethoxysilane (A-187), γ-methacryloxypropyltrimethoxysilane (A-174), vinyl-tris(β-methoxyethoxy)silane (A-172), γ-aminopropyltriethoxysilane (A-1100), vinyltriethoxysilane, β-3,4-epoxycyclohexylethyltrimethoxysilane, and γ-mercaptopropyltrimethoxysilane. In particular, A-187 is effective.

The chromium coupling agents used include methacrylate chromic chloride (MCC; trade name: Volan; a product of DuPont Co.) and Valchrome 5015 (trade name; a product of Valchem, Chemical Div.).

The titanium coupling agent that can be used include tetraisopropyl titanate, tetrabutyl titanate, tetrastearyl titanate, isopropoxytitanium stearate, and titanium lactate.

The silyl peroxide coupling agents that can be used include $(CH_3)_{4-n}Si(OO\text{-t-butyl})_n$,

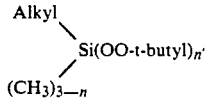

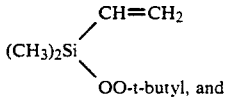

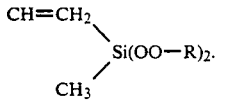

The organic phosphoric acid coupling agents that can be used include;

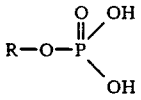

(R: an ethyl, butyl or isoamyl group),

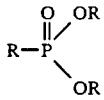

(R: a methyl, ethyl, butyl, 2-ethylhexyl or phenyl group), and

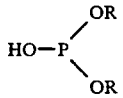

(R: a methyl, ethyl, isopropyl or octyl group).

Methods commonly used in surface treatment of powders can be applied in the surface treatment using the coupling agent.

Taking an example for the silane coupling agents, the surface treatment can be completed using, for example, the following four steps:

(1) A silane coupling agent is dissolved in water (containing a small amount of HCl) or a solvent (containing a small amount of acetic acid).

(2) The resulting solution is heated to not less than 100° C. (Molecules of the coupling agent are hydrolyzed).

(3) Zinc oxide whiskers to be treated are added in this solution to make a well dispersed slurry (A coupling agent molecule reaction layer is formed on the powder surface).

(4) The zinc oxide whiskers are separated from the treatment solution and dried, followed by heat treatment at 150° C. or less.

The binder solution used herein refers to a solution with a low viscosity (for example, a 1 to 50 wt. % solution), obtained by dispersing or dissolving a resin in a solvent. The resin used may particularly preferably include resins capable of being readily dissolved in organic solvents, such as polycarbonate, polystyrene, polyphenylene oxide, acrylic resin, alkyd resin, acetyl cellulose, cyanoethylated cellulose, and cyanoethylated pluran. In the case of thermoplastic resins such as polyvinyl chloride, polypropylene, polyethylene, chlorinated polyethylene, polyethylene terephthalate, polybutylene terephthalate, polyamide, polysulfone, polyether imide, polyether sulfone, polyphenylene sulfide, polyether ketone, ABS resin, polybutadiene, methyl methacrylate, polyacrylonitrile, polyacetal, polycarbonate, an ethylene/vinyl acetate copolymer, polyvinyl acetate, an ethylene/tetrafluoroethylene copolymer, aromatic polyesters, polyvinyl fluoride, polyvinylidene fluoride, polyvinyl chloride, polyvinylidene chloride, and Teflon, they can be used by dispersing or dissolving them in a solvent.

It is also possible to use other thermoplastic resins such as epoxy resin, unsaturated polyester resin, urethane resin, silicone resin, melamine-urea resin, and phenol resin.

The solvent that can be used include organic solvents such as dichloromethane, dichloroethane, acetone, methyl ethyl ketone, nitromethane, acetonitrile, acrylonitrile, dimethylformamide, dimethylsulfoxide, pyridine, dioxane, methylene chloride, tetrahydrofuran, toluene, xylene, cyclohexanone, butyl acetate, xylene, methanol, ethanol, butyl alcohol, and carbon tetrachloride.

The compounding proportion of the zinc oxide whiskers to the resin depends on the size of the whiskers, types of surface treatment, types of resins, types of solvents used, and height of intended electrical conductivity, and thus can not be limitative. It, however, may be not less than 2 vol. % to obtain effect. In particular, it may range from 4 to 50 vol. %, and more preferably from 4 to 20 vol. %, to obtain a stable conductive resin film.

The solution in which there are compounded are thoroughly stirred using a magnetic stirrer or the like, taking care not to cause a break of the tetrapod-like zinc oxide whiskers.

Thereafter, film formation is carried out using a suitable method such as doctor coating, spraying, casting, brushing, bar coating, and spin coating.

Heating or drying follows to complete a conductive resin film. In particular, in the instance of a dispersion system of particles (particle diameter must be not more than the average length of the whiskers) using the thermoplastic resin, the film formation is sometimes completed after the resin has been melted at temperatures higher than the softening point of the resin.

EXAMPLES

The present invention will be described below in a more specific manner by giving Examples. The present invention, however, is by no means limited to these Examples.

EXAMPLE 1

The zinc oxide whiskers described above and polypropylene resin were collected so as to be in amounts of 20 vol. % and 80 vol. %, respectively, and mixed in a V-type rotary mixing machine for 4 minutes, followed by kneading and molding using a different-direction double-shaft extruder to obtain pellets. The resulting pellets were press molded at 240° C. to prepare a disc-like test piece of 50 mm in diameter and 3.5 mm in thickness. On this test piece, dispersion was visually evaluated and specific resistance was measured using a high-resistance meter. Thereafter, a humidity resistance test at 40° C., 100% RH for 7 days was carried out, and then the specific resistance was measured in the same manner as the above.

Results of measurement are shown in Table 1.

EXAMPLE 2

In the same zinc oxide whiskers as Example 1, flaky silver powder (20 to 40 μm in particle size) was mixed in the proportion of 4:1 (volume ratio). The resulting conductive filler and the same polypropylene resin as Example 1 were collected so as to be in amounts of 15 vol. % and 85 vol. %, respectively, and pellets were prepared in the same manner as Example 1 to obtain a test piece, followed by similar evaluation tests. Results obtained are shown in Table 1.

EXAMPLES 3 to 6

As the resin, polybutylene terephthalate, ABS resin, polyphenylene sulfide, and nylon 66 were respectively selected. Whiskers and whisker-mixed fillers were mixed therein to obtain pellets in the same manner as Example 1 and Example 2, and thereafter test pieces were prepared at molding temperatures as shown in Table 1. Results respectively obtained are shown in Table 1. In Examples 5 and 6, the whisker-mixed fillers are different in the types and mixing ratios. The differences are shown in Table 1.

COMPARATIVE EXAMPLES 1 to 4

Using polypropylene as the resin, and metallic flakes and powder as the conductive filler, pellets were obtained in the same manner as Example 1. Thereafter, test pieces were prepared at 240° C., and evaluation tests were carried out in the same manner as Example 1. Results obtained are shown in Table 2.

EXAMPLE 7

In a magnetic pot mill, 100 g of a mixture of 20 vol. % of zinc oxide whiskers and 80 vol. % of polymethyl methacrylate, obtained in the same manner as Example 1, and 150 g of toluene were collected in a magnetic pot mill, and mixed to make a pasty product. This product was spread over a glass sheet and left to stand at room temperature for 2.5 hours, followed by drying at 150° C. for 2 hours to form a coating of 30 μm thick. This was used as a test piece. Evaluation tests were carried out in the same manner as Example 1 to obtain the results as shown in Table 3.

COMPARATIVE EXAMPLE 5

Using 20 vol. % of nickel powder and 80 vol. % of polymethyl methacrylate, a pasty product and a test piece were obtained in the same manner as Example 7, and similar evaluation methods were used. Results of measurement are shown in Table 3.

TABLE 1

| | Composition | | Molding temp. | Evaluation test | | |
|---|---|---|---|---|---|---|
| | | | | Mld. product | Specific resistance (Ω · cm) | |
| | Resin | Filler (vol. %) | (°C.) | appearance | Initial value | After humidity r. test |
| Example: | | | | | | |
| 1 | Polypropylene | ZnO whiskers (100) | 240 | A | 7.1 × 10 | 8 × 10 |
| 2 | Polypropylene | ZnO whiskers (80)<br>Silver powder (20) | 240 | " | 5.0 × 10 | 5.5 × 10 |
| 3 | PBTP | ZnO whiskers (100) | 250 | " | 7.6 × 10 | 7.9 × 10 |
| 4 | ABS resin | ZnO whiskers (100) | 255 | " | 4.3 × 10 | 4.4 × 10 |
| 5 | PPS | ZnO whiskers (85)<br>Aluminum powder (16) | 340 | " | 9.7 × 10 | 1.2 × $10^2$ |
| 6 | Nylon 66 | ZnO whiskers (70)<br>Carbon fiber (30) | 255 | " | 2.2 × 10 | 2.5 × 10 |

Filler amount in Resin Examples 3 and 4: 20 Vol %
Examples 5 and 6: 15 Vol %
A: Uniformly dispersed
PBTP: Polybutylene terephthalate
PPS: Polyphenylene sulfide In Examples 3 to 6, mixed fillers were each added in an amount of 15 vol. %.

TABLE 2

| | Composition | | | Evaluation test | | |
|---|---|---|---|---|---|---|
| | | | | Mld. product | Specific resistance (Ω · cm) | |
| | Resin | Conductive filler (vol. %) | Molding temp. (°C.) | appearance | Initial value | After humidity r. test |
| Comparative Example: | | | | | | |
| 1 | Polypropylene | Aluminum powder (20) | 240 | A | 2.1 × $10^2$ | 5.6 × $10^4$ |
| 2 | Polypropylene | Nickel powder (15) | " | B | 9.9 × $10^2$ | 5.1 × $10^4$ |
| 3 | Polypropylene | Nickel flakes (15) | " | " | 1.1 × $10^3$ | 7.6 × $10^5$ |
| 4 | Polypropylene | Copper powder (15) | " | " | 2.7 × $10^3$ | 8.9 × $10^6$ |

A: Uniformly dispersed
B: Non-uniformly dispersed

Fillers used all had a particle diameter of 5 to 25 μm.

TABLE 3

| Composition | | | Evaluation test | | |
|---|---|---|---|---|---|
| | | | Mld. pro- | Specific resistance (Ω · cm) | |
| Resin | Conductive filler (vol. %) | Molding temp. (°C.) | duct appear-ance | Initial value | After humidity r. test |
| Example: | | | | | |
| 7 PMMA | ZnO whiskers (20) | 170 | A | 1.7 × 10 | 2.1 × 10 |
| Comparative Example: | | | | | |
| 5 PMMA | Nickel powder (20) | " | B | 5.4 × $10^2$ | 7.1 × $10^4$ |

A: Uniformly dispersed
B: Non-uniformly dispersed
PMMA: Polymethyl methacrylate

Fillers used in Comparative Example 5 had a particle diameter of 5 to 25 μm.

EXAMPLE 8

Figure 3:
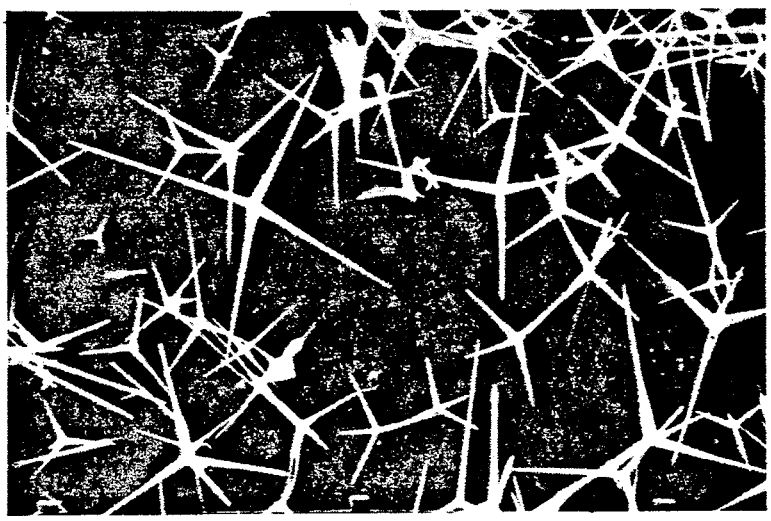

Electroless plating was carried out to apply Ag on the surface of the zinc oxide whiskers as shown in the photograph of FIG. 3. This Ag-coated zinc oxide whiskers and polycarbonate resin were collected, and made into a paste, using dichloromethane. The paste was applied on a glass sheet, followed by drying in an atmosphere of 60° C. for 1 hour to obtain a sheet with a thickness of 200 μm.

Using this sheet as a test piece, resistivity and tensile strength were measured. The amount (vol. %) of whiskers added at which the resistivity may reach the $10^{-2}$ Ω·cm level and tensile strength are shown in Table 4.

COMPARATIVE EXAMPLES 6 TO 9

Using polycarbonate as the resin, zinc oxide whiskers, Ag flakes, Ag powder and Ag-coated glass fiber as the conductive fillers, sheets similarly with a thickness of 200 μm were obtained in the same manner as Example 8. Thereafter, similar evaluation tests were carried out. Results obtained are shown in Table 4.

EXAMPLE 9

Using the sheet obtained in Example 8, electrical conductivity stability to light was evaluated. Results obtained are shown in Table 5.

COMPARATIVE EXAMPLE 10

Using the sheet obtained in Example 6, electrical conductivity stability to light was evaluated. Results obtained are shown in Table 5.

TABLE 4

| Composition | | | (12 Vol %) Evaluation rest | |
|---|---|---|---|---|
| | Filler composition | | Minimum amount of filler ($10^{-2}$ Ω · cm) | Tensile strength (Relative value) |
| Resin | | Surface coat | level) vol. % | |
| Example: | | | | |
| 8 Polycar-bonate | ZnO whiskers | Ag coat | 12 | 1 |
| Comparative Example: | | | | |
| 6 Polycar-bonate | ZnO whiskers | — | Incapable | — |
| 7 Polycar- | Ag flakes | — | 24 | 0.15 |

TABLE 4-continued

| Composition | | | (12 Vol %) Evaluation rest | |
|---|---|---|---|---|
| | Filler composition | | Minimum amount of filler ($10^{-2}$ Ω · cm) | Tensile strength (Relative value) |
| Resin | | Surface coat | level) vol. % | |
| bonate | | | | |
| 8 Polycar-bonate | Ag powder | — | 35 | 0.06 |
| 9 Polycar-bonate | Glass fiber | Ag coat | 26 | 0.30 |

TABLE 5

| Composition | | | Evaluation rest | |
|---|---|---|---|---|
| | Filler composition | | Specific resistance (Ω · cm) | |
| Resin | | Surface coat | 100 lux. | 0.1 lux. |
| Example: | | | | |
| 9 polycar-bonate | ZnO whiskers | Ag coat | 3 × $10^{-2}$ | 3 × $10^{-2}$ |
| Comparative Example: | | | | |
| 10 Polycar-bonate | ZnO whiskers | — | 1 × $10^4$ | 4 × $10^7$ |

EXAMPLE 10

Ag-coated zinc oxide whiskers and polypropylene resin were collected so as to be in amounts of 15 vol. % and 85 vol. %, respectively, and mixed in a V-type rotary mixing machine for 5 minutes, followed by kneading and molding using a different-direction double-shaft extruder to obtain pellets. The resulting pellets were press molded at 240° C. to prepare a disc-like test piece of 75 mm in diameter and 2.0 mm in thickness. On this test piece, dispersion was visually evaluated and specific resistance was measured using a high-resistance meter. Thereafter, a humidity resistance test at 60° C., 100% RH for 7 days was carried out, and then the specific resistance was again measured.

Results of measurement are shown in Table 6 (6-1, 6-2).

EXAMPLE 11

In the zinc oxide whiskers used in Example 10, flaky silver powder (20 to 50 μm in major axis) was mixed in the proportion of 4:1 (volume ratio). The conductive filler thus obtained and polypropylene resin were collected so as to be in amounts of 15 vol. % and 85 vol. %, resectively, and pellets were prepared in the same manner as Example 10 to obtain a test piece, followed by similar evaluation tests. Results obtained are shown in Table 6.

EXAMPLES 12 to 16

As the resin, polybutylene terephthalate, ABS resin, polyphenylene sulfide, and nylon 66 were respectively selected. Whiskers and whisker-mixed fillers were mixed therein to obtain pellets in the same manner as Example 10 and Example 11, and thereafter test pieces were prepared at molding temperatures as shown in Table 6, Evaluation tests were similarly carried out. Results respectively obtained are shown in Table 6. In Examples 15, the whisker-mixed filler is different in the type and mixing ratio. In Example 16, Ni-coated zinc oxide whiskers were employed as the conductive filler. These are respectively shown in Table 6.

COMPARATIVE EXAMPLES 11 TO 14

Using polypropylene as the resin, and metallic flakes and powder as the conductive filler, pellets were obtained in the same manner as Example 10. Thereafter, test pieces were prepared at 230° C., and evaluation tests were carried out in the same manner as Example 10. Results obtained are shown in Table 7.

TABLE 6-1

| | COMPOSITION | | |
|---|---|---|---|
| | | Filler composition | |
| | Resin | (vol. %) | Surface coat |
| Example: | | | |
| 10 | Polypropylene | ZnO whiskers (100) | Ag coat |
| 11 | Polypropylene | ZnO whiskers (80) | Ag coat |
| | | Ag flakes (20) | — |
| 12 | PBTP | ZnO whiskers (100) | Ag coat |
| 13 | ABS resin | ZnO whiskers (100) | Ag coat |
| 14 | PPS | ZnO whiskers (100) | Ag coat |
| 15 | Nylon 66 | ZnO whiskers (70) | Ag coat |
| | | Carbon fiber (30) | — |
| 16 | Polypropylene | ZnO whiskers (100) | Ni coat |

PBTP: Polybutylene terephthalate
PPS: Polyphenylene sulfide

In Examples 12 to 16, fillers were each added in an amount of 15 vol. %.

TABLE 6-2

| | | | Evaluation test Specific resistance (Ω · cm) | |
|---|---|---|---|---|
| | Molding temp. (°C.) | Molded product appearance | Initial value | After humidity resistance test |
| Example: | | | | |
| 10 | 230 | Uniformly dispersed | $4.1 \times 10^{-2}$ | $5.2 \times 10^{-2}$ |
| 11 | 230 | " | $4.8 \times 10^{-2}$ | $5.1 \times 10^{-2}$ |
| 12 | 250 | " | $7.1 \times 10^{-2}$ | $9.8 \times 10^{-2}$ |
| 13 | 255 | " | $3.6 \times 10^{-2}$ | $8.4 \times 10^{-2}$ |
| 14 | 340 | " | $1.2 \times 10^{-1}$ | $4.8 \times 10^{-1}$ |
| 15 | 255 | " | $5.4 \times 10^{-2}$ | $5.5 \times 10^{-2}$ |
| 16 | 230 | " | $3.4 \times 10$ | $1.6 \times 10^{2}$ |

TABLE 7

| | Composition | | | | Evaluation test Specific resistance (Ω · cm) | |
|---|---|---|---|---|---|---|
| | Resin | Conductive filler (vol. %) | Molding temp. (°C.) | Mld. product appearance | Initial value | After humidity r. test |
| Comparative Example: | | | | | | |
| 11 | Polypropylene | Al powder (15) | 230 | A | $4.3 \times 10^{4}$ | $7.1 \times 10^{6}$ |
| 12 | Polypropylene | Ni powder (15) | 230 | B | $3.6 \times 10^{3}$ | $5.5 \times 10^{5}$ |
| 13 | Polypropylene | Ni powder (15) | 230 | " | $2.1 \times 10^{3}$ | $1.1 \times 10^{5}$ |
| 14 | Polypropylene | Cu powder (15) | " | " | $5.1 \times 10^{5}$ | $7.8 \times 10^{11}$ |

A: Uniformly dispersed
B: Non-uniformly dispersed

Fillers used all had a particle diameter of 5 to 25 μm.

EXAMPLE 17

The surfaces of tetrapod-like zinc oxide whiskers of 5 to 30 μm in length from the base to top of the needle crystal part and of 5 to 20 in aspect ratio were coated with antimony tin oxide, and the conductivity was 25 Ω·cm in a pressed powder state of 10 kg/cm$^2$.

This filler was treated in the same manner as Example 8 to obtain a polycarbonate (10 vol. %) sheet with a thickness of 200 μm. This sheet had a resistivity of $4 \times 10^3$ Ω/square.

EXAMPLE 18

Tetrapod-like zinc oxide whiskers were first made ready for use. The length from the base to top of the needle crystal part of this whiskers ranged from 3 to 30 μm, and the diameter at the base was distributed in the range of from 0.7 to 3 μm. The conductivity of the whiskers was $1 \times 10^4$ Ω·cm (t=0.2 mm) in a pressed powder state of 10 kg/cm$^2$.

Next, silane treatment was applied using an A-187 silane coupling agent. More specifically, A-187 was first dissolved in an aqueous hydrochloric acid solution (pH 5). On this occasion, A-187 was in an amount of 1 wt. % based on the amount of the whiskers to be treated. Next, the resulting solution was heated at 80° C. for 1 hour, and thereafter well dried zinc oxide whiskers were charged therein, followed by thorough stirring to obtain a well dispersed slurry. Next, this slurry was filtered under reduced pressure, and dried at 80° C. for 3 hours. The dried product was thereafter thoroughly loosened, followed by heating at 150° C. for 8 hours. The surface treatment was thus completed.

Next, in a beaker, 30 cc of dichloromethane was made ready for use, in which 1 g of polycarbonate powder (Panrite K-1300; Teijin Chemicals Ltd.) was charged with stirring using a magnetic stirrer to obtain a polycarbonate resin varnish.

In this varnish, 1 g of tetrapod-like zinc oxide whiskers having been subjected to silane treatment was charged. The content was thoroughly stirred and dispersed, and then spread over a glass sheet to carry out film formation using a doctor blade. Next, the film formed was dried in a dryer of 60° C. for 1 hour. After cooling, the resulting film was peeled from the glass sheet, and used for evaluation and measurement. The film formed had an average film thickness of 200 μm. The whiskers were compounded in a proportion of about 17 vol. % (50 wt. %).

The film thus prepared was cut with a size of 6 mm×30 mm. Both ends thereof were fastened with clips, under which the resistivity in the longitudinal direction was measured. This resistivity was read, and, taking account of film thickness, the volume resistivity (Ω·cm) was calculated. Results obtained are shown in Table 8. This film had a smooth surface, and was rich in flexibility. A film of $10^5$ Ω·cm or less, measured by this method, can be used as a conductive film for electrostatic coating, having very various uses and applications.

COMPARATIVE EXAMPLE 15

Using tetrapod-like zinc oxide whiskers having the same size as Example 18 but not applied with the silane treatment, a film was prepared in entirely the same manner as Example 18, and evaluation was also made to obtain the results as shown in Table 8. This film showed extreme agglomeration between whiskers, having a crumbly surface and a very poor film quality.

COMPARATIVE EXAMPLE 16

Tetrapod-like zinc oxide whiskers with larger shapes were made ready for use, and a film was prepared in entirely the same manner as Example 18. Evaluation was also made to obtain the results as shown in Table 8. This film had a somewhat irregular surface.

COMPARATIVE EXAMPLE 17

Tetrapod-like zinc oxide whiskers with smaller shapes were made ready for use, and a film was prepared in entirely the same manner as Example 18. Evaluation was also made to obtain the results as shown in Table 8.

COMPARATIVE EXAMPLE 18

Commercially available zinc white (No. 1; French method) were made ready for use, and a film was prepared in entirely the same manner as Example 18. Evaluation was also made to obtain the results as shown in Table 8.

COMPARATIVE EXAMPLE 19

The tetrapod-like zinc oxide whiskers having been applied with silane treatment, as used in Example 18, was made ready for use.

Next, in a brabender heated to 300° C., polycarbonate resin pellets (Panrite K-1300; Teijin Chemicals Ltd.) and the above whiskers were kneaded (compounding proportion: 50 wt. %), and a film with a thickness of 200 μm was similarly prepared pressing under conditions of 300° C.

Next, the resulting film was evaluated in the same manner as Example 18 to obtain the results as shown in Table 8.

EXAMPLE 19

Tetrapod-like zinc oxide whiskers were applied with a silane treatment in the same manner as Example 18, and thoroughly mixed under the compounding formulation as shown in Formulation 1. The mixture was then spray coated on a glass sheet, followed by drying at room temperature for 30 minutes, and thereafter evaluation was made. Results obtained are shown in Table 8.

| Formulation 1: | |
|---|---|
| Zinc oxide whiskers | 5 g |
| Acrylic resin varnish (Acryldic A-165) | 20 g |
| Toluene | 9 g |
| Butyl alcohol | 9 g |
| Film thickness was 200 μm. | |

EXAMPLE 20

Tetrapod-like zinc oxide whiskers were applied with a silane treatment in the same manner as Example 18, and thoroughly mixed under the compounding formulation as shown in Formulation 2. The mixture was then spread on a glass sheet and formed into a film with a thickness of 200 μm using a doctor blade, followed by natural drying at room temperature for 6 hours, and thereafter evaluation was made. Results obtained are shown in Table 8.

| Formulation 2: | |
|---|---|
| Alkyd resin varnish (Beckozol 1334) | 45 g |
| Zinc oxide whiskers | 20 g |
| Mineral spirit | 19.3 g |
| Cobalt naphthate | 0.2 g |
| Lead naphthate | 0.5 g |

EXAMPLE 21

First, the tetrapod-like zinc oxide whiskers having been applied with silane treatment in Example 18 was made ready for use. Next, polypropylene fine powder pulverized to a diameter of 0.5 μm was made ready for use. Both of these were thoroughly stirred and dispersed in dichloromethane to obtain a uniform slurry. The compounding proportion of the whiskers was 35 wt. %. This slurry was applied on a glass sheet and formed into a film using a doctor blade, followed by drying in an atmosphere of 60° C. for 1 hour. The resulting film was then put into a 260° C. constant temperature chamber for 10 minutes, and polypropylene was dissolved. A film was thus formed. This film (thickness: 200 μm) was peeled from the glass sheet, and evaluation was made to obtain the results as shown in Table 8.

COMPARATIVE EXAMPLE 20

The tetrapod-like zinc oxide whiskers having been applied with silane treatment, as used in Example 18, was made ready for use.

Next, they were compounded (50 wt. %) in a non-solvent type low-viscosity two-pack epoxy resin, and thoroughly dispersed therein. Thereafter, the resulting dispersion was spread over a glass sheet, and formed into a film (thickness: 200 μm) using a doctor blade, followed by drying at 90° C. for 5 hours, and thereafter evaluation was made. Results obtained are shown in Table 8.

TABLE 8

| | Resin | Zinc oxide whiskers Size | Surface treatment | Volume resistivity Ω · cm | Film quality |
|---|---|---|---|---|---|
| Example: | | | | | |
| 18 | Polycarbonate | L: 3~30 μm D: 0.7~3 μmϕ | Yes | $5 \times 10^3$ | AA |
| 19 | Acrylate | L: 10~80 μm D: 1~8 μmϕ | Yes | $8 \times 10^3$ | AA |
| 20 | Alkyd | L: 3~10 μm D: 0.7~1 μmϕ | Yes | $2 \times 10^3$ | AA |
| 21 | Polypropylene | L: 3~80 μm D: 0.7~8 μmϕ | Yes | $1 \times 10^4$ | AA |
| Comparative Example: | | | | | |
| 15 | Polycarbonate | L: 3~30 μm D: 0.7~3 μmϕ | No | $1.5 \times 10^6$ | C |
| 16 | Polycarbonate | L: 150~200 μm D: 4~20 μmϕ | Yes | $2 \times 10^6$ | B |
| 17 | Polycarbonate | L: 0.1~1 μm D: 0.01~0.2 μmϕ | Yes | $8 \times 10^8$ | A |
| 18 | Polycarbonate | (0.52 μm)* | Yes | $3 \times 10^{10}$ | A |
| 19 | Polycarbonate | L: 3~30 μm D: 0.7~3 μmϕ | Yes | $4 \times 10^{10}$ | A |
| 20 | Epoxy | L: 3~30 μm | Yes | $4 \times 10^6$ | B |

TABLE 8-continued

| Resin | Zinc oxide whiskers Size | Surface treatment | Volume resistivity Ω · cm | Film quality |
|---|---|---|---|---|
| (no solvent) | | | | |

L: length.
D: diameter.
*Average particle diameter

EXAMPLE 22

Figure 4:
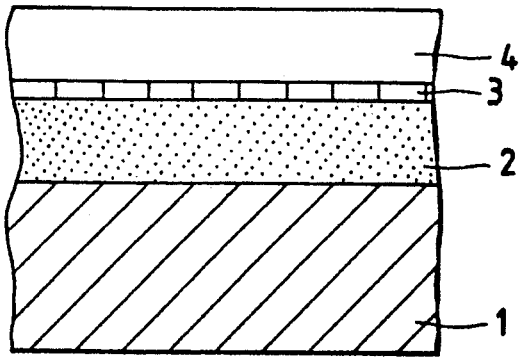
FIGS. 4 to 7, 10 and 11 are partial cross sections of the electrophotographic photosensitive members employing the present invention.

FIG. 4 illustrates the constitution of a negatively chargeable functionally separated electrophotographic photosensitive member having a laminated structure of a charge generation layer and a charge transport layer. In FIG. 4, the numeral 1 denotes a support.

As previously described, the support can be used by forming, for example, a metal having electrical conductivity, such as aluminum, brass, stainless steel, copper or nickel, a non-conductive plastic such as polyethylene terephthalate resin, polyethylene resin, urethane resin, acrylic resin or polyacrylate resin, or a rigid paper, in the shape of a drum or forming them into a film or foil. Since the electrophotographic photosensitive member of the present invention can have a smooth conductive layer, the surface of the support may be rough, and hence it is unnecessary to make cutting on the support, making it possible to greatly reduce the cost for the support.

In FIG. 4, the numeral 2 denotes a conductive layer containing at least the tetrapod-like zinc oxide whiskers.

The binder resin in which the tetrapod-like zinc oxide whiskers are dispersed must satisfy the requirements that it has good adhesion to the support, it has excellent dispersibility, and it may not be affected by the solvent contained in the coating solutions for the photosensitive layer or protective layer formed on the conductive layer, or by the heat generated when the layer is formed. Hence, it may preferably include thermosetting resins such as polyurethane resins, epoxy resins, polyester resins, silicone resins, acrylic melamine resins, and phenol resins. The conductive layer may preferably have a volume specific resistivity of not more than $10^8$ Ω·cm, and more preferably $10^6$ Ω·cm. Taking account of operability also and so forth, a suitable content of the resin in the conductive layer ranges from 10 to 90 wt. %, and preferably from 20 to 70 wt. %.

The tetrapod-like zinc oxide whiskers with a low resistivity can be readily obtained by burning ZnO with addition of compounds such as Al and In. Alternatively, they can be obtained by adding in a solution prepared by dispersing tetrapod-like zinc oxide whiskers in heated water a solution prepared by dissolving tetrapod-like zinc oxide whiskers and oxidation number unsaturated stannous chloride, stannous bromide, antimony trichloride or antimony triiodide in alcohol, hydrochloric acid or acetone, followed by filtration and drying. Hence, it is also possible to add a non-conductive pigment to use it in combination. Examples thereof include titanium oxide, calcium carbonate, alumina, talc, and clay, which are effective for saving cost.

Addition of conventionally available powder of metals such as nickel, copper, silver and aluminum, carbon black, ZnO doped with Al, In, Sn, Sb or the like, $TiO_2$ doped with In, Sn or the like, $SnO_2$ doped with Sb, Nb or the like, TiO, or a mixture of some of these to use them in combination can give tetrapod-like zinc oxide whiskers whose spaces or gaps are filled with them, making it possible to obtain a conductive layer having a more stable electrical conductivity.

Dispersion to the conductive layer can be carried out using a ball mill, a vibrating ball mill or a sand mill.

In the instance where the support is in the form of a sheet, blade coaters, wire bar coaters or screen coaters are suited. In the instance where the support is in the form of a drum, dip coating is suited.

In FIG. 4, the photosensitive layer is of a functionally separated type comprised of the charge generation layer designated as 3 and the charge transport layer designated as 4. The charge generation layer 3 is formed of a pigment or dye capable of generating carriers as a result of exposure and a binder resin. The charge transport layer 4 is formed of a material capable of transporting charges and a binder resin.

Charge-generating materials are various pigments or dyes of a phthalocyanine type, an azo type, a squalilium type, a cyanine type, a quinocyanine type, an indigo type, a bisbenzoimidazole type and a perylene type. Charge-transporting materials are compounds having on the backbone chain or side chain an electron donative group such as an alkyl group, an alkoxy group, an amino group, an imino group or an imido group, polycyclic aromatic compounds such as anthracene, phenanthrene and pyrene, or derivatives containing any of these, and heterocyclic compounds such as indole, oxazole, isoxazole, carbazole, pyrazoline, imidazole, oxadiazole, thiazole and triazole, or derivatives containing any of these. The above charge-generating materials and charge-transporting materials commonly have so a low molecular weight and poor film forming properties that they must be dissolved or dispersed in a binder resin having film forming properties. The binder resin used here includes thermoplastic resins such as polycarbonate resin, acrylic resin, polyvinyl chloride resin and butyral resin, and thermosetting resins such as melamine resin, urethane resin, epoxy resin, silicone resin and phenol resin. The charge generation layer may most desirably have a film thickness of not more than 1 μm, and the charge transport layer, a film thickness ranging from 10 to 25 μm.

The photosensitive layer, comprising amorphous silicon, can be readily obtained by glow discharge, plasma CVD or the like, and may preferably have a film thickness ranging from 15 to 25 μm.

First, a pure zinc wire with a purity of 99.99% was flame sprayed in the air according to flame spraying of an arch discharge system, and 1 kg of the resulting powder was charged into 500 g of ion-exchanged water, followed by stirring using a crusher of a morter type for 20 minutes. Next, the resulting dispersion was left to stand in water kept at 26° C., for 72 hours, followed by drying at 150° C. for 30 minutes to remove the moisture content in the powder surfaces. Next, the resulting powder was put in a crucible made of alumina porcelain, which was then put in a furnace kept at 1,000° C., followed by heat treatment for 1 hour. As a result, bulk zinc oxide was produced in the above crucible at the lower layer part thereof, and tetrapod-like zinc oxide whisker crystals having an apparent bulk specific gravity of 0.09 and comprising a central part and a needle crystal part extending to different four axial directions from the central part were obtained therein at the upper layer part. Fine whiskers were then collected from the whiskers produced at the upper layer part.

About 6 g of tetrapod-like zinc oxide whisker powder thus obtained was put in an insulating cylinder of 6 mm in inner diameter, and the resistivity was measured while applying pressure with platinum electrodes from the both sides under a pressure of 70 kg/cm$^2$. As a result, it was found to be 50 Ω·cm.

In a ball mill, 5 parts by weight of the resulting tetrapod-like zinc oxide whiskers and 3 parts by weight of a 3:2 mixed binder resin of acrylic resin (a product of Mitsubishi Rayon Co., Ltd.; trade name: Dianal HR-124) and melamine resin (a product of Dainippon Ink & Chemicals Incorporated; trade name: Super Beckamin L121) were put, together with 10 parts by weight of a 1:1:2 mixed solvent of xylene, cyclohexanone and n-butanol. These were dispersed for 15 hours to prepare a uniformly dispersed coating solution, followed by filtration under pressure using a filter of 5 μm, in order to remove dust and foreign matters in the coating solution. The resulting coating solution was subjected to ultrasonic cleaning using trichloroethylene, and then applied by dip coating at a coating rate of 50 mm/min, on an aluminum drum support of 60 mm in diameter end 338 mm in width from the surface of which dust and stains have been removed, followed by curing at 150° C. for 60 minutes. The conductive layer 2 was thus formed with a thickness of 20 μm.

Next, 4 parts by weight of γ-type metal-free phthalocyanine as the charge-generating material, 3 parts by weight of butyral resin (a product of Sekisui Chemical Co., Ltd.; trade name: Eslec BH-3) and 92 parts by weight of tetrahydrofuran were put in a ball mill, and dispersed for 12 hours to prepare a uniformly dispersed coating solution, followed by filtration under pressure using a filter of 5 μm, in order to remove dust and foreign matters in the coating solution. Using this coating solution, dip coating was carried out at a coating rate of 40 mm/min on the conductive layer 2 previously formed, followed by hot-air drying at 100° C. for 60 minutes. The charge generation layer 3 was thus formed with a thickness of 0.25 μm.

A coating solution was further prepared by dissolving 1 part by weight of 1-phenyl-1,2,3,4-tetrahydroquinoline-6-carboxyaldehydo-1',1'-diphenylhydrazone as the charge-transporting material and 1 part by weight of polycarbonate resin (a product of Mitsubishi Chemical Industries Limited; trade name: Novalex 7030A) in 9 parts by weight of methylene chloride, and then filtration under pressure was carried out using a filter of 1 μm, in order to remove dust and foreign matters in the coating solution. This coating solution was applied by dip coating at a coating rate of 70 mm/min, on the support on which the conductive layer 2 and charge generation layer 3 have been formed, followed by hot-air drying at 80° C. for 60 minutes. The charge transport layer 4 was thus formed with a thickness of 20 μm.

Figure 8:
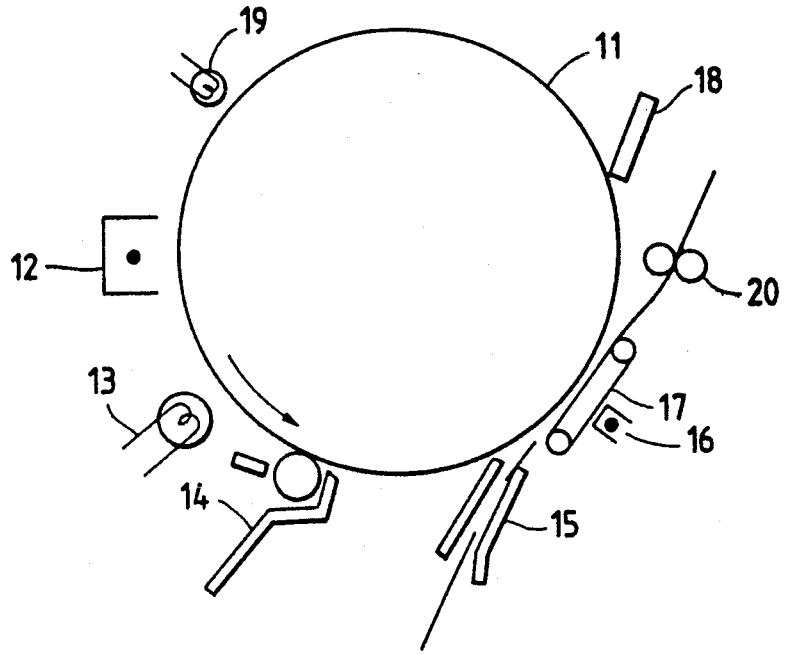
FIGS. 8 and 9 are schematic cross sections of electrophotographic copying machines.

Performance of the electrophotographic photosensitive member prepared in this way was measured using the electrophotographic copying machine of a reversal development type as shown in FIG. 8. In FIG. 8, the numeral 11 denotes an electrophotographic photosensitive member, which is in the form of a drum. Around this electrophotographic photosensitive member, disposed are a negative electrostatic charger 12, an exposure light source 13 such as a tungsten lamp or a semiconductor laser, a developing device 14 having a negatively chargeable toner, a transfer guide 15, a positive electrostatic charger 16, a transfer belt 17, a cleaning blade 18 and a destaticizing light source 19, and also provided is a fixing device 20 used to fix a toner image transferred. The electrophotographic photosensitive member 11 is rotated in the direction of the arrow, and first the electrophotographic photosensitive member 11 is negatively charged so that an electrostatic latent image corresponding with information sigals is formed using the exposure light source 13. This negatively charged electrostatic latent image is developed by the developing device 14 having a negatively chargeable toner and turned to a visible image, which is then transferred by the action of the positive electrostatic charger 16, on a sheet of copy paper carried through the transfer guide 15. The image-transferred copy paper sheets are successively separated from the electrophotographic photosensitive member 11 by the operation of the transfer belt 17, where the image is fixed by the fixing device 20. The toner remaining on the electrophotographic photosensitive member after transfer is recovered with the cleaning blade 18, and residual potential is removed using the destaticizing light source 19.

Using this electrophotographic copying machine, performance was measured. The measurement was carried out in a constant temperature room in which the temperature and humidity can be controlled, to evaluate i) potential characteristics based on electrostatic charge potential and residual potential of the electrophotographic photosensitive member, using a surface potentiometer Model 344 manufactured by Trec Co., and ii) image characteristics based on whether or not black dots are present on a white solid image and image density is lowered. This measurement was made under normal conditions of 25° C. and 55% RH, low-humidity conditions of 10° C. and 20% RH, or high-humidity conditions of 30° C. and 80% RH. Results obtained are shown in Table 9.

As is evident from Table 9, an electrophotographic photosensitive member was obtained which shows superior potential characteristics and image characteristics under conditions of 25° C./55% RH, 10° C./20% RH and 30° C./80% RH, respectively.

EXAMPLE 23

Figure 5:
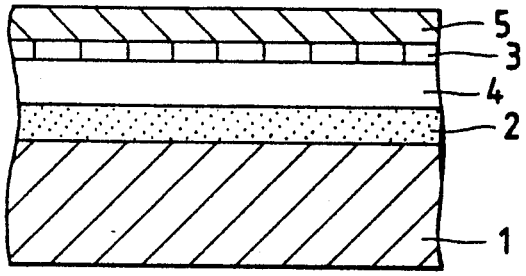

FIG. 5 illustrates the constitution of a positively chargeable functionally separated electrophotographic photosensitive member having a structure in which the charge generation layer and the charge transport layer are reversely laminated.

In FIG. 5, the numeral 1 denotes a support; 2, a conductive layer; 4, a charge transport layer; 3, a charge generation layer; and 5, a protective layer. Resins suited for the protective layer may preferably include thermoplastic resins such as polycarbonate resin, acrylic resin, polyvinyl chloride resin and butyral resin, and thermosetting resins such as melamine resin, urethane resin, epoxy resin, silicone resin and phenol resin. The protective layer may most desirably have a film thickness ranging from 1 to 10 μm, since an excessively small thickness may result in lack of cleaning resistance and wear resistance, and an excessively large thickness may cause an increase in residual potential.

First, 500 g of the tetrapod-like zinc oxide whiskers obtained in Example 22 was added in 3,000 cc of water kept at 90° C. While stirring the resulting mixture, a solution obtained by dissolving the tetrapod-like zinc oxide whiskers and 10 g of oxidation number unsaturated antimony trichloride in 200 cc of ethanol was slowly added therein, followed by filtration and washing, and then drying at 100° C. for 2 hours. About 6 g of tetrapod-like zinc oxide whisker powder thus obtained was put in an insulating cylinder of 6 mm in inner diameter, and the resistivity was measured while applying pressure with platinum electrodes from the both sides under a pressure of 70 kg/cm$^2$. As a result, it was found to be 0.12 Ω·cm.

In a vibrating ball mill, 10 parts by weight of the resulting tetrapod-like zinc oxide whiskers made to have a low resistivity, 10 parts by weight of phenol resin of a resol type (a product of Dainippon Ink & Chemicals Incorporated; trade name: Praiofen 5592; solid content: 55%) and 10 parts by weight of a 1:1 mixed solvent of methanol and n-butanol were put, and these were dispersed for 20 hours to prepare a uniformly dispersed coating solution, followed by filtration under pressure using a filter of 10 μm, in order to remove dust and foreign matters in the coating solution. The resulting coating solution was subjected to ultrasonic cleaning using trichloroethylene, and then applied by dip coating at a coating rate of 60 mm/min, on an aluminum drum support of 60 mm in diameter and 338 mm in width from the surface of which dust and stains have been removed, followed by curing at 150° C. for 45 minutes. The conductive layer 2 was thus formed with a thickness of 16 μm.

A coating solution was further prepared by dissolving 12 parts by weight of the charge-transporting material 1-phenyl-1,2,3,4-tetrahydroquinoline-6-carboxyaldehydo-1',1'-diphenylhydrazone used in Example 22 and 10 parts by weight of polycarbonate resin (a product of Bayer Co.; trade name: Macrohole N) in 19 parts by weight of methylene chloride, and then filtration under pressure was carried out using a filter of 1 μm, in order to remove dust and foreign matters in the coating solution. This coating solution was applied by dip coating at a coating rate of 50 mm/min, on the support on which the conductive layer 2 has been formed, followed by hot-air drying at 80° C. for 60 minutes. The charge transport layer 4 was thus formed with a thickness of 22 μm. Next, 4 parts by weight of ε-type metal-free phthalocyanine as the charge-generating material, 4 parts by weight of a 3:1 mixed binder resin of acrylic resin (a product of Mitsubishi Rayon Co., Ltd.; trade name: Dianal HR-664) and melamine resin (a product of Dainippon Ink & Chemicals Incorporated; trade name: Super Beckamin L121) as binder resins and 92 parts by weight of 2-butanol were put in a vibrating ball mill, and dispersed for 15 hours to prepare a uniformly dispersed coating solution, followed by filtration under pressure using a filter of 5 μm, in order to remove dust and foreign matters in the coating solution. Using this coating solution, dip coating was carried out at a coating rate of 30 mm/min on the conductive layer 2 on which the conductive layer 2 and charge transport layer 4 have been formed, followed by curing at 100° C. for 60 minutes. The charge generation layer 3 was thus formed with a thickness of 0.21 μm.

Finally, a coating solution comprising 1 part by weight of a 3:1 mixed binder resin of acrylic resin (a product of Mitsubishi Rayon Co., Ltd.; trade name: Dianal HR-664) and melamine resin (a product of Dainippon Ink & Chemicals Incorporated; trade name: Super Beckamin L121) and 5 parts by weight of a 3:1 mixed solution of 2-butanol and toluene were put in a vibrating ball mill was prepared, and filtration under pressure was carried out using a filter of 1 μm, in order to remove dust and foreign matters in the coating solution. Using this coating solution, dip coating was carried out at a coating rate of 50 mm/min on the support on which the conductive layer 2, charge transport layer 4 and charge generation layer 3 have been formed, followed by curing at 80° C. for 30 minutes. The protective layer 5 was thus formed with a thickness of 2.0 μm.

Figure 9:
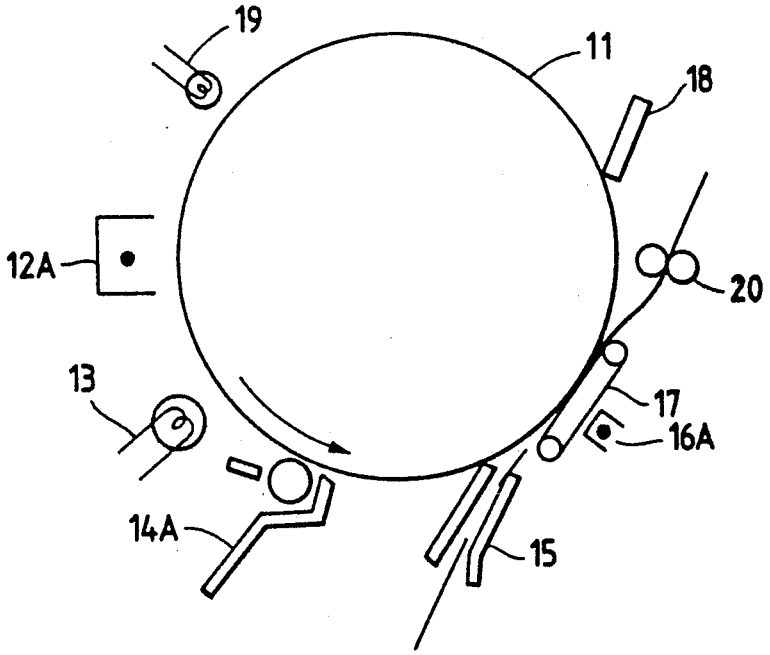

The potential characteristics and image characteristics of the electrophotographic photosensitive member prepared in this way were evaluated in the same manner as Example 22, using an electrophotographic copying machine of a reversal development type as shown in FIG. 9, in which the negative electrostatic charger 12 in FIG. 8 was changed to a positive electrostatic charger 12A, the developing device 14 having a negatively chargeable toner to a developing device 14A having a positively chargeable toner, and the positive electrostatic charger 16 to a negative electrostatic charger 16A. Results obtained are shown in Table 9.

As is evident from Table 9, an electrophotographic photosensitive member was obtained which shows superior potential characteristics and image characteristics under conditions of 25° C./55% RH, 10° C./80% RH, respectively.

EXAMPLE 24

Figure 6:
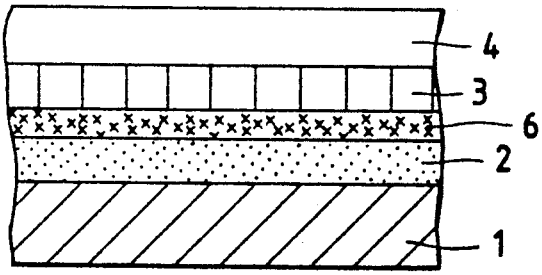

FIG. 6 illustrates the constitution of a negatively chargeable functionally separated electrophotographic photosensitive member having an intermediate layer between the conductive layer and photosensitive layer of Example 22.

In FIG. 6, the numeral 1 denotes a support; 2, a conductive layer; 6, an intermediate layer; 3, a charge generation layer; and 4, a charge transport layer.

Providing the intermediate layer between the above conductive layer and photosensitive layer can prevent it from occurring that a photosensitive material is burried in fine holes caused by the tetrapod-like zinc oxide whiskers, the photosensitive layer turn uneven because of projections, or the electrophotographic performance is affected by the mutual action with the photosensitive material, when the photosensitive layer is directly provided on the conductive layer containing at least the tetrapod-like zinc oxide whiskers. Thus, it is possible to obtain an electrophotographic photosensitive member having a higher reliability and greater lifetime.

Materials used in the intermediate layer 6 include polyvinyl alcohol, methyl cellulose, ethyl cellulose, casein, gelatin, starch, polyamide resins and phenol resins. The polyamide resins, however, were found to be most desirable. Of the polyamide resins, preferred is an alcohol-soluble copolymer polyamide resin, taking account of the properties as an adhesion layer and operability. The intermediate layer should preferably have a film thickness ranging from 0.2 to 1.0 μm.

First, 8 parts of the tetrapod-like zinc oxide whiskers obtained in Example 22, 2 parts by weight of conducting agent of $TiO_2$ type (a product of Mitsubishi Kinzoku Kosan K.K.; trade name: W-10) and 3 parts by weight of a 3:2 mixed binder resin of acrylic resin (a product of Mitsubishi Rayon Co., Ltd.; trade name: Dianal HR-124) and melamine resin (a product of Dainippon Ink & Chemicals Incorporated; trade name: Super Beckamin L121), together with 10 parts by weight of a 1:1:2 mixed solvent of xylene, cyclohexane and n-butanol, were put in a ball mill, and these were dispersed for 15 hours to prepare a uniformly dispersed coating solution, followed by filtration under pressure using a filter of 5 μm, in order to remove dust and foreign matters in the coating solution. The resulting coating solution was subjected to ultrasonic cleaning using trichloroethylene, and then applied by dip coating at a coating rate of 60 mm/min, on a resol type phenol resin drum support 1 of 60 mm in diameter and 338 mm in width from the surface of which dust and stains have been removed, followed by curing at 140° C. for 90 minutes. The conductive layer 2 was thus formed with a thickness of 20 μm.

Next, a coating solution was further prepared by dissolving 1 part by weight of polyamide resin (a product of Toray Industries, Inc.; trade name: Aramin CM8000) in 9 parts by weight of methanol, followed by filtration under pressure using a filter of 1 μm, in order to remove dust and foreign matters in the coating solution. This coating solution was applied by dip coating at a coating rate of 60 mm/min, on the support on which the conductive layer 2 has been formed, followed by hot-air drying at 100° C. for 60 minutes. The intermediate layer 6 was thus formed with a thickness of 0.2 μm. Next, the same charge generation layer 3 and charge transport layer 4 as Example 22 were formed.

The potential characteristics and image characteristics of the electrophotographic photosensitive member obtained in this way were measured in the same manner as Example 22. Results obtained are shown in Table 9.

As is evident from Table 9, an electrophotographic photosensitive member was obtained which shows superior potential characteristics and image characteristics under conditions of 25° C./55% RH, 10° C./20% RH and 30° C./80% RH, respectively.

EXAMPLE 25

Figure 7:
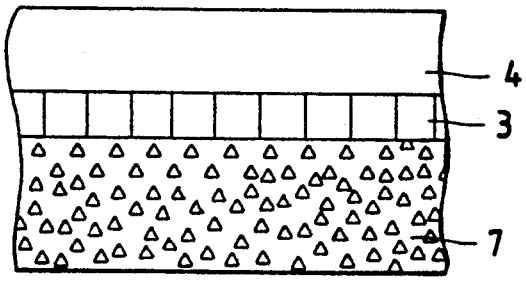

FIG. 7 illustrates the constitution of a negatively chargeable functionally separated electrophotographic photosensitive member having the photosensitive layer on a conductive support.

In FIG. 7, the numeral 7 denotes a conductive support containing at least the tetrapod-like zinc oxide whiskers; 3, a charge generation layer; and 4, a charge transport layer.

The binder resin in which the tetrapod-like zinc oxide whiskers are dispersed must satisfy the requirements that it has excellent dispersibility, and it may not be affected by the solvent contained in the coating solutions for the photosensitive layer or protective layer formed on the conductive support, or by the heat generated when the layer is formed. Hence, it may preferably include thermosetting resins such as polyurethane resin, epoxy resin, polyester resin, silicone resin, acrylic melamine resin, and phenol resin. Thermoplastic resins such as polypropylene resin and ABS resin, however, may also be used. The conductive support may preferably have a volume specific resistivity of not more than $10^8$ Ω·cm, and more preferably $10^6$ Ω·cm. Taking account of operability also and so forth, a suitable content of the resin in the conductive support ranges from 10 to 90 wt. %, and preferably from 20 to 50 wt. %.

The tetrapod-like zinc oxide whiskers with a low resistivity can be readily obtained by burning ZnO with addition of compounds such as Al and In. Alternatively, they can be obtained by adding in a solution prepared by dispersing tetrapod-like zinc oxide whiskers in heated water a solution prepared by dissolving tetrapod-like zinc oxide whiskers and oxidation number unsaturated stannous chloride, stannous bromide, antimony trichloride or antimony triiodide in alcohol, hydrochloric acid or acetone, followed by filtration and drying. Hence, it is also possible to add a non-conductive pigment to use it in combination. Examples thereof include titanium oxide, calcium carbonate, alumina, talc, and clay, which are effective for saving cost.

Addition of conventionally available powder of metals such as nickel, copper, silver and aluminum, carbon black, ZnO doped with Al, In, Sn, Sb or the like, $TiO_2$ doped with In, Sn or the like, $SnO_2$ doped with Sb, Nb or the like, TiO, or a mixture of some of these to use them in combination can give tetrapod-like zinc oxide whiskers whose spaces or gaps are filled with them, making it possible to obtain a conductive support having a more stable electrical conductivity.

First, the tetrapod-like zinc oxide whiskers obtained in Example 22 were added in phenol resin in an amount of 25 wt. %, followed by kneading, and the kneaded product was molded into a cylinder of 56 mm in inner diameter, 60 mm in outer diameter and 338 mm in width to obtain the conductive support 7. This well satisfied the strength, dimensional stability, surface smoothness, impact resistance, etc. as a support.

Ultrasonic cleaning using trichloroethylene was carried out on the conductive support 7 thus obtained, to remove dust and stains on the surface. Thereafter, the same charge generation layer 3 and charge transport layer 4 as Example 22 were formed.

The potential characteristics and image characteristics of the electrophotographic photosensitive member obtained in this way were measured in the same manner as Example 22. Results obtained are shown in Table 9.

As is evident from Table 9, an electrophotographic photosensitive member was obtained which shows superior potential characteristics and image characteristics under conditions of 25° C./55% RH, 10° C./20% RH and 30° C./80% RH, respectively.

COMPARATIVE EXAMPLE 21

As a comparative example, a conducting agent of a metallic oxide type was used in place of the tetrapod-like zinc oxide whiskers used in Example 22. In a ball mill, 10 parts by weight of a conducting agent of metallic oxide type (a product of Mitsubishi Kinzoku Kosan K.K.; trade name: T-1), 3 parts by weight of a 3:2 mixed binder resin of acrylic resin (a product of Mitsubishi Rayon Co., Ltd.; trade name: Dianal HR-124) and melamine resin (a product of Dainippon Ink & Chemicals Incorporated; trade name: Super Beckamin L121), and 10 parts by weight of a 1:1:2 mixed solvent of xylene, cyclohexane and n-butanol were put, and dispersed for 15 hours to prepare a uniformly dispersed coating solution, followed by filtration under pressure using a filter of 5 μm, in order to remove dust and foreign matters in the coating solution. The resulting coating solution was subjected to ultrasonic cleaning using trichloroethylene, and, immediately after the coating solution was thoroughly stirred because the conductive materials dispersed therein tended to be sedimented, applied by dip coating at a coating rate of 60 mm/min, on an aluminum drum support 1 of 60 mm in diameter and 338 mm in width from the surface of which dust and stains have been removed, followed by curing at 150° C. for 60 minutes. The conductive layer 2 was thus formed with a thickness of 20 μm. On this layer, the same charge generation layer 3 and charge transport layer 4 as Example 22 were formed to prepare an electrophotographic photosensitive member. On this electrophotographic photosensitive member, the potential characteristics and image characteristics were measured in the same manner as Example 22. Results obtained are shown in Table 9.

As is seen from Table 9, the electrophotographic photosensitive member showed superior potential characteristics and image characteristics under conditions of 25° C./55% RH and 30° C./80% RH. Under conditions of 10° C./20% RH, however, there appeared areas at which the image density was lowered presumably because the residual potential locally increased.

COMPARATIVE EXAMPLE 22

As a comparative example, a conducting agent of a polymeric electrolyte was used in place of the tetrapod-like zinc oxide whiskers used in Example 22. A coating solution was prepared, which was obtained by dissolving 10 parts by weight of polyvinyl methylbenzyltrimethylammonium chloride (a product of Dow-Corning Corp.; trade name: ECR-34) and 3 parts by weight of polyvinyl alcohol (a product of Nihon Gosei Kako Co., Ltd.; trade name: Gosenol AH-17) in 87 parts by weight of distilled water, and filtration under pressure was carried out using a filter of 1 μm, in order to remove dust and foreign matters in the coating solution. The resulting coating solution was subjected to ultrasonic cleaning using trichloroethylene, and then applied by dip coating at a coating rate of 70 mm/min, on an aluminum drum support 1 of 60 mm in diameter and 338 mm in width from the surface of which dust and stains have been removed, followed by hot-air drying at 100° C. for 60 minutes. The conductive layer 2 was thus formed with a thickness of 15 μm. On this layer, the same charge generation layer 3 and charge transport layer 4 as Example 22 were formed to prepare an electrophotographic photosensitive member. On this electrophotographic photosensitive member, the potential characteristics and image characteristics were measured in the same manner as Example 22. Results obtained are shown in Table 9.

As is seen from Table 9, the electrophotographic photosensitive member showed superior potential characteristics and image characteristics under conditions of 25° C./55% RH. Under conditions of 10° C./20% RH, however, there occurred an increase in the residual potential and, accompanying it, a lowering of the image density. Under conditions of 30° C./80% RH, a lowering of the residual density and black dots on a white solid image were caused.

TABLE 9

| | Results of measurement of performance of electrophotographic photosensitive member | | | |
|---|---|---|---|---|
| | Environmental conditions for measurement | Potential characteristics: Charge potential | Potential characteristics: Residual potential | Image characteristics (White solid image) |
| Example: | | | | |
| 22 | 25° C./55% RH | −700 V | −40 V | Normal |
| | 10° C./20% RH | −710 V | −50 V | Normal |
| | 30° C./80% RH | −690 V | −35 V | Normal |
| 23 | 25° C./55% RH | +705 V | −70 V | Normal |
| | 10° C./20% RH | +705 V | −85 V | Normal |
| | 30° C./80% RH | +690 V | −60 V | Normal |
| 24 | 25° C./55% RH | −700 V | −50 V | Normal |
| | 10° C./20% RH | −705 V | −70 V | Normal |
| | 30° C./80% RH | −590 V | −35 V | Normal |
| 25 | 25° C./55% RH | −695 V | −40 V | Normal |
| | 10° C./20% RH | −700 V | −50 V | Normal |
| | 30° C./80% RH | −700 V | −35 V | Normal |
| Comparative Example: | | | | |
| 21 | 25° C./55% RH | −695 V | −40 V | Normal |
| | 10° C./20% RH | −710 V | −75 V | (1) |

TABLE 9-continued

| | Results of measurement of performance of electrophotographic photosensitive member | | | |
|---|---|---|---|---|
| | Environmental conditions for measurement | Potential characteristics: Charge potential | Potential characteristics: Residual potential | Image characteristics (White solid image) |
| | 30° C./80% RH | −690 V | −35 V | Normal |
| 22 | 25° C./55% RH | −710 V | −30 V | Normal |
| | 10° C./20% RH | −715 V | −140 V | (1) |
| | 30° C./80% RH | −620 V | −25 V | (2) |

(1): Lowering of image density occurred.
(2): Black dots appeared.

EXAMPLE 26

Figure 10:
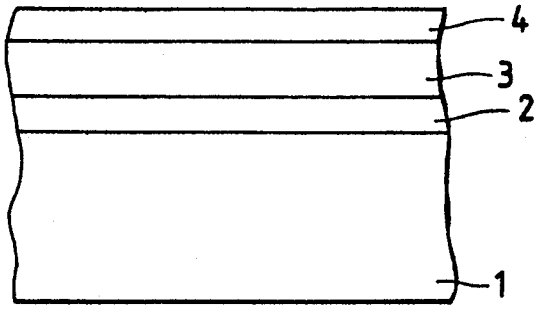

FIG. 10 illustrates the constitution of a negatively chargeable functionally separated electrophotographic photosensitive member having a laminated structure of a charge generation layer and a charge transport layer. In FIG. 10, the numeral 1 denotes a support.

The support 1 may be a support having by itself the electrical conductivity, as exemplified by metals having electrical conductivity, such as aluminum, brass, stainless steel, copper or nickel, or a non-conductive plastic such as polyethylene terephthalate resin, polyethylene resin, urethane resin, acrylic resin or polyacrylate resin or a rigid paper on which a conductive layer comprising a conducting agent such as carbon, metallic powder, metallic oxide or a conductive polymer, dispersed in a suitable binder resin, is formed. Alternatively, a conductive support filled with the above conducting agent is suited.

In FIG. 10, the photosensitive layer is of a functionally separated type comprised of the charge generation layer designated as 2 and the charge transport layer designated as 3. The charge generation layer 2 is formed of a pigment or dye capable of generating carriers as a result of exposure and a binder resin. The charge transport layer 3 is formed of a material capable of transporting charges and a binder resin.

In FIG. 10, the numeral 4 denotes a protective layer containing at least the tetrapod-like zinc oxide whiskers.

The binder resin in which the tetrapod-like zinc oxide whiskers are dispersed must satisfy the requirements that it has good adhesion to the photosensitive layer and it has excellent dispersibility. Hence, it may preferably include thermoplastic resins such as polycarbonate resin, acrylic resin, polyvinyl chloride resin and butyral resin, and thermosetting resins such as polyurethane resins, epoxy resins, polyester resins, silicone resins, acrylic melamine resins, and phenol resins. The tetrapod-like zinc oxide whiskers contained in the protective layer should preferably have the size such that the size of the central part is not more than 0.5 and the size including the central part and the needle crystal part extending to different four axial directions from the central part is not more than 2 μm. The protective layer should also have a volume specific resistivity ranging from $10^9$ to $10^{13}$ Ω·cm, and preferably from $10^{10}$ to $10^{12}$ Ω·cm. A suitable content of the zinc oxide whiskers in the conductive layer ranges from 0.1 to 30 wt. %, and preferably from 0.5 to 20 wt. %, because an excessively large amount may result in a lowering of the transparency of the protective layer to cause a lowering of the sensitivity of the photosensitive layer.

The protective layer should preferably have a film thickness ranging from 0.5 to 10 μm, taking account of the scratches caused by toners, durability such as slide resistance, and whether or not a lowering of the sensitivity of the photosensitive layer may be caused.

The tetrapod-like zinc oxide whiskers with a low resistivity can be readily obtained by buring ZnO with addition of compounds such as Al and In. Alternatively, they can be obtained by adding in a solution prepared by dispersing tetrapod-like zinc oxide whiskers in heated water a solution prepared by dissolving tetrapod-like zinc oxide whiskers and oxidation number unsaturated stannous chloride, stannous bromide, antimony trichloride or antimony triiodide in alcohol, hydrochloric acid or acetone, followed by filtration and drying. Hence, it is also possible to obtain a protective layer having the desired resistivity, with addition of a smaller amount of the zinc oxide whiskers.

Dispersion to the protective layer can be carried out using a ball mill, a vibrating ball mill or a sand mill.

In the instance where the support is in the form of a sheet, blade coaters, wire bar coaters or screen coaters are suited. In the instance where the support is in the form of a drum, dip coating is suited.

First, 4 parts by weight of $\gamma$-type metal-free phthalocyanine as the charge-generating material, 3 parts by weight of butyral resin (a product of Sekisui Chemical Co., Ltd.; trade name: Eslec BH-3) and 92 parts by weight of tetrahydrofuran were put in a ball mill, and dispersed for 12 hours to prepare a uniformly dispersed coating solution, follwed by filtration under pressure using a filter of 5 $\mu$m, in order to remove dust, foreign matters and agglomerates in the coating solution. The resulting coating solution was subjected to ultrasonic cleaning using trichloroethylene, and then applied by dip coating at a coating rate of 40 mm/min, on an aluminum drum support of 60 mm in diameter and 338 mm in width from the surface of which dust and stains have been removed, followed by hot-air drying at 100° C. for 60 minutes. The charge generation layer 2 was thus formed with a thickness of 0.25 $\mu$m.

Next, a coating solution was prepared by dissolving 1 part by weight of 1-phenyl-1,2,3,4-tetrahydroquinoline-6-carboxyaldehydo-1',1'-diphenylhydrazone as the charge-transporting material and 1 part by weight of polycarbonate resin (a product of Mitsubishi Chemical Industries Limited; trade name: Novalex 7030A) in 9 parts by weight of methylene chloride, and then filtration under pressure was carried out using a filter of 1 $\mu$m, in order to remove dust and foreign matters in the coating solution. This coating solution was applied by dip coating at a coating rate of 70 mm/min, on the support on which the charge generation layer 2 has been formed, followed by hot-air drying at 80° C. for 60 minutes. The charge transport layer 3 was thus formed with a thickness of 20 $\mu$m.

A pure zinc wire with a purity of 99.99% was further flame sprayed in the air according to flame spraying of an arch discharge system, and 1 kg of the resulting powder was charged into 500 g of ion-exchanged water, followed by stirring using a crusher of a morter type for 20 minutes. Next, the resulting dispersion was left to stand in water kept at 26° C., for 72 hours, followed by drying at 150° C. for 30 minutes to remove the moisture content in the powder surfaces. Next, the resulting powder was put in a crucible made of alumina porcelain, which was then put in a furnace kept at 1,000° C., followed by heat treatment for 1 hour. As a result, bulk zinc oxide was produced in the above crucible at the lower layer part thereof, and tetrapod-like zinc oxide whisker crystals having an apparent bulk specific gravity of 0.09 and comprising a central part and a needle crystal part extending to different four axial directions from the central part were obtained therein at the upper layer part. Fine whiskers were then collected from the whiskers produced at the upper layer part. The tetrapod-like zinc oxide whiskers thus obtained were classified to obtain those wherein the size including the central part and the needle crystal part extending to different four axial directions from the central part is not more than 1.5 $\mu$m. The size of the central part was not more than 0.4 $\mu$m. About 6 g of the tetrapod-like zinc oxide whisker powder was put in an insulating cylinder of 6 mm in inner diameter, and the resistivity was measured while applying pressure with platinum electrodes from the both sides under a pressure of 70 kg/cm$^2$. As a result, it was found to be 35 $\Omega$·cm.

In a ball mill, 2 parts by weight of the resulting tetrapod-like zinc oxide whiskers and 20 parts by weight of a 3:2 mixed binder resin of acrylic resin (a product of Mitsubishi Rayon Co., Ltd.; trade name: Dianal HR-124) and melamine resin (a product of Dainippon Ink & Chemicals Incorporated; trade name: Super Beckamin L121) were put, together with 50 parts by weight of a 5:1 mixed solvent of n-butanol and toluene. These were dispersed for 15 hours to prepare a uniformly dispersed coating solution, followed by filtration under pressure using a filter of 2 $\mu$m, in order to remove dust, foreign matters and agglomerates in the coating solution. The resulting coating solution was applied by dip coating at a coating rate of 40 mm/min, on the support on which the charge generation layer and charge transport layer have been formed, followed by hot-air drying at 100° C. for 60 minutes. The protective layer 4 was thus formed with a thickness of 5.3 $\mu$m.

Performance of the electrophotographic photosensitive member prepared in this way was measured using the electrophotographic copying machine of a reversal development type as shown in FIG. 8. In FIG. 8, the numeral 11 denotes an electrophotographic photosensitive member, which is in the form of a drum. Around this electrophotographic photosensitive member, disposed are a negative electrostatic charger 12, an exposure light source 13 such as a tungsten lamp or a semiconductor laser, a developing device 14 having a negatively chargeable toner, a transfer guide 15, a positive electrostatic charger 16, a transfer belt 17, a cleaning blade 18 and a destaticizing light source 19, and also provided is a fixing device 20 used to fix a toner image transferred. The electrophotographic photosensitive member 11 is rotated in the direction of the arrow, and first the electrophotographic photosensitive member 11 is negatively charged so that an electrostatic latent image corresponding with information signals is formed using the exposure light source 13. This negatively charged electrostatic latent image is developed by the developing device 14 having a negatively chargeable toner and turned to a visible image, which is then transferred by the action of the positive electrostatic charger 16, on a sheet of copy paper carried through the transfer guide 15. The image-transferred copy paper sheets are successively separated from the electrophotographic photosensitive member 11 by the operation of the transfer belt 17, where the image is fixed by the fixing device 20. The toner remaining on the electrophotographic photosensitive member after transfer is recovered with the cleaning blade 18, and residual potential is removed using the destaticizing light source 19.

Using this electrophotographic copying machine, performance was measured. The measurement was carried out in a constant temperature room in which the temperature and humidity can be controlled, to evaluate i) potential characteristics based on electrostatic charge potential and residual potential of the electrophotographic photosensitive member, using a surface potentiometer Model 344 manufactured by Trec Co., and ii) image characteristics based on whether or not black dots and fog are present on a white solid image, cleaning resistance, and defective images caused by scratches on the surface of the photosensitive member. This measurement was made at the initial stage and after 10,000 sheet running tests under normal conditions of 25° C. and 55% RH, low-humidity conditions of 10° C. and 20% RH, or high-humidity conditions of 30° C. and 80% RH. Results obtained are shown in Table 10.

As is evident from Table 10, an electrophotographic photosensitive member was obtained which shows superior potential characteristics and image characteristics at the initial stage and after 10,000 sheet running tests under conditions of 25° C./55% RH, 10° C./20% RH and 30° C./80% RH, respectively,

EXAMPLE 27

Figure 11:
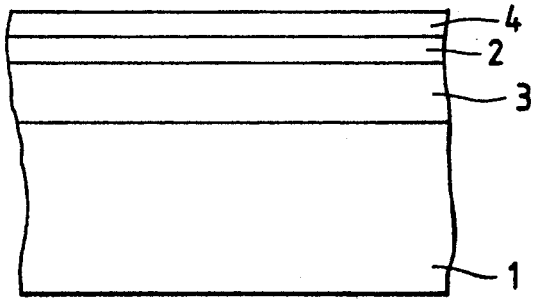

FIG. 11 illustrates the constitution of a positively chargeable functionally separated electrophotographic photosensitive member having a structure in which the charge generation layer and the charge transport layer are reversely laminated.

In FIG. 11, the numeral 1 denotes a support; 3, a charge transport layer; 2, a charge generation layer; and 4, a protective layer.

A coating solution was first prepared by dissolving 12 parts by weight of the charge-transporting material 1-phenyl-1,2,3,4-tetrahydroquinoline-6-carboxyaldehydo-1',1'-diphenylhydrazone used in Example 26 and 10 parts by weight of polycarbonate resin (a product of Bayer Co.; trade name: Macrohole N) in 19 parts by weight of methylene chloride, and then filtration under pressure was carried out using a filter of 1 μm, in order to remove dust and foreign matters in the coating solution. This coating solution was subjected to ultrasonic cleaning using trichloroethylene and then applied by dip coating at a coating rate of 50 mm/min, on an aluminum drum support of 60 mm in diameter and 338 mm in width from the surface of which dust and stains have been removed, followed by hot-air drying at 80° C. for 60 minutes. The charge transport layer 3 was thus formed with a thickness of 22 μm. Further, 4 parts by weight of ε-type metal-free phthalocyanine as the charge-generating material, 4 parts by weight of a 3:1 mixed binder resin of acrylic resin (a product of Mitsubishi Rayon Co., Ltd.; trade name: Dianal HR-664) and melamine resin (a product of Dainippon Ink & Chemicals Incorporated; trade name: Super Beckamin L121) as binder resins and 92 parts by weight of 2-butanol were put in a vibrating ball mill, and dispersed for 15 hours to prepare a uniformly dispersed coating solution, followed by filtration under pressure using a filter of 5 μm, in order to remove dust, foreign matters and agglomerates in the coating solution. Using this coating solution, dip coating was carried out at a coating rate of 30 mm/min on the support on which the charge transport layer 3 has been formed, followed by curing at 100° C. for 60 minutes. The charge generation layer 2 was thus formed with a thickness of 0.18 μm.

Next, 500 g of the tetrapod-like zinc oxide whiskers obtained in Example 26 was added in 3,000 cc of water kept at 90° C. While stirring the resulting mixture, a solution obtained by dissolving the tetrapod-like zinc oxide whiskers and 10 g of oxidation number unsaturated antimony trichloride in 200 cc of ethanol was slowly added therein, followed by filtration and washing, and then drying at 100° C. for 2 hours. The tetrapod-like zinc oxide whiskers thus obtained were classified to obtain those wherein the size including the central part and the needle crystal part extending to different four axial directions from the central part is not more than 2 μm. The size of the central part was not more than 0.5 μm. About 6 g of the powder thus obtained was put in an insulating cylinder of 6 mm in inner diameter, and the resistivity was measured while applying pressure with platinum electrodes from the both sides under a pressure of 70 kg/cm$^2$. As a result, it was found to be 0.09 Ω·cm.

A coating solution comprising 2 parts by weight of the resulting tetrapod-like zinc oxide whiskers made to have a low resistivity, 100 parts by weight of a 3:1 mixed binder resin of acrylic resin (a product of Mitsubishi Rayon Co., Ltd.; trade name: Dianal HR-664) and melamine resin (a product of Dainippon Ink & Chemicals Incorporated; trade name: Super Beckamin L145), and 100 parts by weight of a 5:1 mixed solvent of n-butanol and toluene was prepared, followed by filtration under pressure using a filter of 2 μm, in order to remove dust, foreign matters and agglomerates in the coating solution. The resulting coating solution was applied by dip coating at a coating rate of 40 mm/min, on the support on which the charge transport layer 3 and charge generation layer 2 have been formed, followed by hot-air drying at 80° C. for 60 minutes. The protective layer 4 was thus formed with a thickness of 1.5 μm.

The potential characteristics and image characteristics of the electrophotographic photosensitive member prepared in this way were evaluated in the same manner as Example 22, using an electrophotographic copying machine of a reversal development type as shown in FIG. 9, in which the negative electrostatic charger 12 in FIG. 8 was changed to a positive electrostatic charger 12A, the developing device 14 having a negatively chargeable toner to a developing device 14A having a positively chargeable toner, and the positive electrostatic charger 16 to a negative electrostatic charger 16A. Results obtained are shown in Table 10.

As is evident from Table 10, an electrophotographic photosensitive member was obtained which shows superior charge potential, residual potential and image characteristics at the initial stage and after 10,000 sheet running tests under conditions of 25° C./55% RH, 10° C./20% RH and 30° C./80% RH, respectively.

COMPARATIVE EXAMPLE 23

As a comparative example, a metallic oxide was used in place of the tetrapod-like zinc oxide whiskers used in Example 26. The charge generation layer 2 and charge transport layer 3 were formed on the same aluminum support as in Example 26. Next, 2 parts by weight of a conducting agent of metallic oxide type (a product of Mitsubishi Kinzoku Kosan K.K.; trade name: T-1), 20 parts by weight of a 3:2 mixed binder resin of acrylic resin (a product of Mitsubishi Rayon Co., Ltd.; trade name: Dianal HR-124) and melamine resin (a product of Dainippon Ink & Chemicals Incorporated; trade name:

Super Beckamin L121), and 50 parts by weight of a 5:1 mixed solvent of n-butanol and toluene were put in a ball mill, and dispersed for 15 hours to prepare a uniformly dispersed coating solution, followed by filtration under pressure using a filter of 2 μm, in order to remove dust, foreign matters and agglomerates in the coating solution. The resulting coating solution was, immediately after the coating solution was thoroughly stirred because the conductive materials dispersed therein tended to be sedimented, applied by dip coating at a coating rate of 40 mm/min, on the support on which the charge generation layer and charge transport layer have been formed, followed by hot-air drying at 100° C. for 60 minutes. The protective layer 4 was thus formed with a thickness of 4.5 μm. On this electrophotographic photosensitive member thus prepared, the potential characteristics and image characteristics were measured in the same manner as Example 26. Results obtained are shown in Table 10.

As is seen from Table 10, the electrophotographic photosensitive member showed superior potential characteristics and image characteristics at the initial stage and after 10,000 sheet running tests under conditions of 25° C./55% RH. At the initial stage under conditions of 30° C./80% RH, however, black dots on a solid white image were seen, which were presumed to be due to the agglomeration of the metallic oxide. At the initial stage under conditions of 10° C./20% RH also, a lowering of the image density was caused presumably because the residual potential locally increased, which became more serious with progress of the running tests.

COMPARATIVE EXAMPLE 24

As a comparative example, fine powder of polytetrafluoroethylene was used in place of the tetrapod-like zinc oxide whiskers used in Example 26. The charge generation layer 2 and charge transport layer 3 were formed on the same aluminum support as in Example 26. Next, 2 parts by weight of fine powder of polytetrafluoroethylene (a product of Daikin Industries, Ltd.; trade name: Lublon L2), 20 parts by weight of a 3:2 mixed binder resin of acrylic resin (a product of Mitsubishi Rayon Co., Ltd.; trade name: Dianal HR-124) and melamine resin (a product of Dainippon Ink & Chemicals Incorporated; trade name Super Beckamin L121), and 50 parts by weight of a 5:1 mixed solvent of n-butanol and toluene were put in a ball mill, and dispersed for 15 hours to prepare a uniformly dispersed coating solution, followed by filtration under pressure using a filter of 2 μm, in order to remove dust, foreign matters and agglomerates in the coating solution. The resulting coating solution was applied by dip coating at a coating rate of 40 mm/min, on the support on which the charge generation layer and charge transport layer have been formed, followed by hot-air drying at 100° C. for 60 minutes. The protective layer 4 was thus formed with a thickness of 5.1 μm. On this electrophotographic photosensitive member thus prepared, the potential characteristics and image characteristics were measured in the same manner as Example 26. Results obtained are shown in Table 10.

As is seen from Table 10, the electrophotographic photosensitive member showed superior potential characteristics and image characteristics at the initial stage and after 10,000 sheet running tests under conditions of 25° C./55% RH and 30° C./80% RH, respectively. At the initial stage under conditions of 10° C./20% RH, however, a lowering of the image density was caused presumably because the residual potential locally increased, which became more serious with progress of the running tests, and turned to give little image density after the 10,000 sheet running.

TABLE 10-1

Results of measurement of performance of electrophotographic photosensitive member Characteristics at the initial stage

| | Environmental conditions for measurement | Potential characteristics: Charge potential | Potential characteristics: Residual potential | Image characteristics |
|---|---|---|---|---|
| Example: | | | | |
| 26 | 25° C./55% RH | −700 V | −100 V | Normal |
| | 10° C./20% RH | −715 V | −125 V | Normal |
| | 30° C./80% RH | −690 V | −90 V | Normal |
| 27 | 25° C./55% RH | 705 V | 80 V | Normal |
| | 10° C./20% RH | 705 V | 95 V | Normal |
| | 30° C./80% RH | 700 V | 75 V | Normal |
| Comparative Example: | | | | |
| 23 | 25° C./55% RH | −690 V | −120 V | Normal |
| | 10° C./20% RH | −710 V | −140 V | (1) |
| | 30° C./80% RH | −685 V | −110 V | (2) |
| 24 | 25° C./55% RH | −700 V | −140 V | Normal |
| | 10° C./20% RH | −715 V | −200 V | (1) |
| | 30° C./80% RH | −690 V | −130 V | Normal |

(1) Lowering of image density occurred.
(2) Black dots appeared.

TABLE 10-2

Results of measurement of performance of electrophotographic photosensitive member Characteristics after 10,000 sheet running

| | Environmental conditions for measurement | Potential characterisitcs: Charge potential | Potential characterisitcs: Residual potential | Image characteristics (comp'd with initial stage |
|---|---|---|---|---|
| Example: | | | | |
| 26 | 25° C./55% RH | −710 V | −105 V | Normal |
| | 10° C./20% RH | −735 V | −140 V | Normal |
| | 30° C./80% RH | −675 V | −95 V | Normal |
| 27 | 25° C./55% RH | 710 V | 90 V | Normal |
| | 10° C./20% RH | 725 V | 110 V | Normal |
| | 30° C./80% RH | 690 V | 85 V | Normal |
| Comparative Example: | | | | |
| 23 | 25° C./55% RH | −700 V | −135 V | Normal |
| | 10° C./20% RH | −730 V | −165 V | (3) |
| | 30° C./80% RH | −685 V | −115 V | (4) |
| 24 | 25° C./55% RH | −710 V | −140 V | Normal |
| | 10° C./20% RH | −730 V | −315 V | (5) |
| | 30° C./80% RH | −690 V | −135 V | Normal |

(3): Extreme lowering of image density occurred.
(4): Black dots increased.
(5): No image density given.

As described in the above, the conductive resin composition can be made into various molded products when formed into powder or pellets. The molded products can achieve a uniformly dispersed state without causing the separation of the resin and filler in carrying out the molding. In particular, the electrical conductivity can be made very high because of the effect of the zinc oxide whiskers, even with the addition thereof in a small amount. Moreover, the products undergo less changes with time and humidity resistance deterioration, and hence can be preferably used as materials for preventing electrostatic destruction, antistatic materials, materials for preventing electromagnetic wave hindrance, and materials for preventing corona discharge. In these uses, the composition can be molded by molding processes such as compression molding, extrusion molding, and injection molding. The paste can be used as conductive covering materials, conductive adhesives, etc. In addition, because of the effect that can be great with the addition of the above material in a small amount, the physical properties inherent in the resin can be less impaired, and also, in some instances, physical properties superior to those in the case only the resin is used can be discovered. Thus, the present conductive resin composition is greatly worth using.

According to the method of making the conductive resin composition useful for forming the conductive resin film of the present invention, a suitable electrical conductivity can be obtained, and it is possible to obtain a conductive resin film without no limitations on the hue, free from the deterioration due to oxidation, and rich in the flexibility.

In the electrophotographic photosensitive member according to the present invention, the conductive layer containing at least the tetrapod-like zinc oxide whiskers is provided between the support and photosensitive layer, and thereby the adhesion between the support and conductive layer and between the conductive layer and photosensitive layer can be made superior. In particular, a remarkable effect is seen when a photosensitive layer (or charge generation layer) in which the phthalocyanine pigment or azo pigment has been dispersed or a photosensitive layer comprising amorphous silicon, about which the adhesion has bee hiterto questioned, is formed on the conductive layer. Moreover, the materials may not sedimented when formed into a coating solution, to bring about superior operability. Thus, it has been made possible to obtain a conductive layer having a stable electrical conductivity through the whiskers.

The conductive support obtained by filling a lightweight and inexpensive plastic with at least the tetrapod-like zinc oxide whiskers, well satisfies the strength, dimensional stability and impact resistance required as the support, and can omit the surface polishing required for supports made of metals. Thus, it has been made possible to obtain a conductive support which is inexpensive, has a stable electrical conductivity through the tetrapod-like zinc oxide whiskers and has a superior adhesion to the photosensitive layer.

In addition, providing the intermediate layer between the conductive layer containing the tetrapod-like zinc oxide whiskers and photosensitive layer can prevent it from occurring that a photosensitive material is burried in fine holes caused by the tetrapod-like zinc oxide whiskers, the photosensitive layer turn uneven because of projections, or the electrophotographic performance is affected by the mutual action with the photosensitive material. Thus, it has been made possible to obtain an electrophotographic photosensitive member having a higher reliability and greater lifetime.

Another electrophotographic photosensitive member according to the present invention is provided on the photosensitive layer with the protective layer containing at least the tetrapod-like zinc oxide whiskers. Hence, it is possible to obtain a protective layer that has a superior adhesion to the photosensitive layer, and, moreover, has superior operability since the materials, when formed into a coating solution, may not be sedimented or agglomerated, and has a uniform resistivity without any local difference in the resistivity, through the tetrapodlike zinc oxide whiskers added in a small amount. The protective layer also has excellent environmental stability because its resistivity is based on electron conduction. Thus, it has been made possible to obtain an electrophotographic photosensitive member having the protective layer that may not lower the resolution of the photosensitive layer and also can be stable to changes in use environment.

What is claimed is:

1. A conductive resin composition which forms a conductive layer positioned between a support and a photosensitive layer of an electrophotographic photosensitive member, which comprises a resin and conductive zinc oxide whiskers, incorporated in an amount of from 10 to 90% by weight, each having an aspect ratio of not less than 3 and a tetrapod structure comprising a central part and a needle crystal part, wherein the length from the base to the top of the needle crystal part is from 3 to 200 μm.

2. A conductive resin composition according to claim 1, wherein the tetrapod zinc oxide whiskers incorporated form an electrical conducting path.

3. A conductive resin composition according to claim 1, wherein the needle crystal part of any one of the tetrapod zinc oxide whiskers incorporated is brought into contact with at least one needle crystal part of another zinc oxide whisker.

4. A conductive resin composition according to claim 1, wherein the needle crystal part of the tetrapod structure of the zinc oxide whiskers is composed of at least one selected from the group consisting of a four-axial crystal, a three-axial crystal, a two-axial crystal and a one-axial crystal, wherein a part or parts of the four-axial crystals are broken in the case of the three-axial crystal, the two-axial crystal and the one-axial crystal.

5. A conductive resin composition according to claim 1, wherein the length from the base to the top of the needle crystal part is from 3 to 80 μm.

6. A conductive resin composition according to claim 1, wherein the length from the base to the top of the needle crystal part is from 10 to 200 μm.

7. A conductive resin composition according to claim 1, wherein the length from the base to the top of the needle crystal part is from 10 to 80 μm.

8. A conductive resin composition according to claim 1, wherein the diameter at the base of the needle crystal part is from 0.7 to 14 μm.

9. A conductive resin composition according to claim 1, wherein the diameter at the base of the needle crystal part is from 0.7 to 8 μm.

10. A conductive resin composition according to claim 1, wherein the surface of the zinc oxide whiskers is treated with a coupling agent.

11. A conductive resin composition for a resinous conductive support of an electrophotographic photosensitive member, which comprises a resin and conductive zinc oxide whiskers, incorporated in an amount of from 10 to 90% by weight, each having an aspect ratio of not less than 3 and a tetrapod structure comprising a central part and a needle crystal part, wherein the length from the base to the top of the needle crystal part is from 3 to 200 μm.

12. A conductive resin composition according to claim 11, wherein the tetrapod zinc oxide whiskers incorporated form an electrical conductive path.

13. A conductive resin composition according to claim 11, wherein the needle crystal part of any one of the tetrapod zinc oxide whiskers incorporated is brought into contact with at least one needle crystal part of another zinc oxide whisker.

14. A conductive resin composition according to claim 11, wherein the needle crystal part of the tetrapod structure of the zinc oxide whiskers is composed of at least one selected from the group consisting of a four-axial crystal, a three-axial crystal, a two-axial crystal and a one-axial crystal, wherein a part or parts of the four-axial crystals are broken in the case of the three-axial crystal, the two-axial crystal and the one-axial crystal.

15. A conductive resin composition according to claim 11, wherein the length from the base to the top of the needle crystal part is from 3 to 80 μm.

16. A conductive resin composition according to claim 11, wherein the length from the base to the top of the needle crystal part is from 10 to 200 μm.

17. A conductive resin composition according to claim 11, wherein the length from the base to the top of the needle crystal part is from 10 to 80 μm.

18. A conductive resin composition according to claim 11, wherein the diameter at the base of the needle crystal part is from 0.7 to 14 μm.

19. A conductive resin composition according to claim 11, wherein the diameter at the base of the needle crystal part is from 0.7 to 8 μm.

20. A conductive resin composition according to claim 11, wherein the surface of the zinc oxide whiskers is treated with a coupling agent.

21. A conductive resin composition for a protective layer positioned on a photosensitive layer of an electrophotographic photosensitive member, which comprises a resin and conductive zinc oxide whiskers, incorporated in an amount of from 0.1 to 30% by weight, each having an aspect ratio of not less than 3 and a tetrapod structure comprising a central part and a needle crystal part, wherein the length from the base to the top of the needle crystal part is from 3 to 200 μm.

22. A conductive resin composition according to claim 21, wherein the tetrapod zinc oxide whiskers incorporated form an electrical conductive path.

23. A conductive resin composition according to claim 21, wherein the needle crystal part of any one of the tetrapod zinc oxide whiskers incorporated is brought into contact with at least one needle crystal part of another zinc oxide whisker.

24. A conductive resin composition according to claim 21, wherein the needle crystal part of the tetrapod structure of the zinc oxide whiskers is composed of at least one selected from the group consisting of a four-axial crystal, a three-axial crystal, a two-axial crystal and a one-axial crystal, wherein a part or parts of the four axial crystals are broken in the case of the three-axial crystal, the two-axial crystal and the one-axial crystal.

25. A conductive resin composition according to claim 21, wherein the length from the base to the top of the needle crystal part is from 3 to 80 μm.

26. A conductive resin composition according to claim 21, wherein the length from the base to the top of the needle crystal part is from 10 to 200 μm.

27. A conductive resin composition according to claim 21, wherein the length from the base to the top of the needle crystal part is from 10 to 80 μm.

28. A conductive resin composition according to claim 21, wherein the diameter at the base of the needle crystal part is from 0.7 to 14 μm.

29. A conductive resin composition according to claim 21, wherein the diameter at the base of the needle crystal part is from 0.7 to 8 μm.

30. A conductive resin composition according to claim 21, wherein the surface of the zinc oxide whiskers is treated with a coupling agent.

* * * * *